US006997750B2

(12) United States Patent
Johannes et al.

(10) Patent No.: US 6,997,750 B2
(45) Date of Patent: Feb. 14, 2006

(54) ELECTRICAL CONNECTOR CONTACT

(75) Inventors: Richard A. Johannes, Lake Orion, MI (US); William R. Lyons, Southfield, MI (US); Michael S. Glick, Farmington Hills, MI (US); Franklin A. Holub, West Bloomfield, MI (US); Raymond Bruce McLauchlan, Macomb Township, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/878,453

(22) Filed: Jun. 28, 2004

(65) Prior Publication Data

US 2005/0020136 A1 Jan. 27, 2005

Related U.S. Application Data

(60) Provisional application No. 60/525,495, filed on Nov. 25, 2003, provisional application No. 60/489,891, filed on Jul. 23, 2003.

(51) Int. Cl.
*H01R 13/66* (2006.01)

(52) U.S. Cl. ..... 439/620; 439/843

(58) Field of Classification Search ..... 439/620, 439/843–846

See application file for complete search history.

(56) References Cited

U.S. PATENT DOCUMENTS

| | | | | | |
|---|---|---|---|---|---|
| 3,003,135 | A | * | 10/1961 | Purinton | 439/843 |
| 3,564,487 | A | * | 2/1971 | Upstone et al. | 439/843 |
| 4,466,688 | A | | 8/1984 | Singer, Jr. | 339/252 |
| 4,685,761 | A | | 8/1987 | Locati | 439/843 |
| 4,734,064 | A | | 3/1988 | Knapp et al. | 439/852 |
| 4,780,097 | A | * | 10/1988 | Piscitelli | 439/843 |
| 5,108,318 | A | * | 4/1992 | Sakurai et al. | 439/744 |
| 5,188,545 | A | | 2/1993 | Hass et al. | 439/851 |
| 5,199,910 | A | | 4/1993 | Kahle et al. | 439/843 |
| 5,200,574 | A | | 4/1993 | Cunningham et al. | 102/530 |
| 5,213,522 | A | | 5/1993 | Kojima | 439/620 |
| 5,241,910 | A | | 9/1993 | Cunningham et al. | 102/530 |
| 5,322,459 | A | | 6/1994 | Spinnato | 102/530 |
| 5,419,723 | A | | 5/1995 | Villiers et al. | 439/843 |
| 5,462,459 | A | | 10/1995 | Childs | 439/843 |
| 5,489,220 | A | | 2/1996 | Hanna et al. | 439/620 |
| 5,516,310 | A | | 5/1996 | Sawada | 439/843 |
| 5,529,517 | A | | 6/1996 | Hopf et al. | 439/843 |
| 3,286,222 | A | | 11/1996 | Drinkwater | 339/258 |
| 5,599,212 | A | | 2/1997 | Sawada | 439/843 |
| 5,713,746 | A | | 2/1998 | Olson et al. | 439/79 |
| 5,897,404 | A | | 4/1999 | Goodman et al. | 439/843 |
| 6,045,415 | A | | 4/2000 | May et al. | 439/852 |
| 6,086,434 | A | | 7/2000 | Rollero et al. | 439/852 |
| 6,152,775 | A | | 11/2000 | Pavlovic | 439/620 |
| 6,217,388 | B1 | * | 4/2001 | Francis | 439/620 |

(Continued)

*Primary Examiner*—Gary Paumen
(74) *Attorney, Agent, or Firm*—Harrington & Smith, LLP

(57) ABSTRACT

An electrical connector assembly including a housing, electrical contact terminals, a hood and a filter member. The housing is sized and shaped to be plugged into an electrical connector socket of an initiator of a gas generator. A first one of the terminals has a wire connection section and a female connection section. The hood surrounds the female connection section of the first terminal. The hood is a stamped and rolled sheet metal member which has a general tube shape. The filter member is connected to the first terminal for providing electromagnetic induction suppression. The filter member can be on a filter assembly having a multi-capacitor chip attached to a spring lead frame.

24 Claims, 24 Drawing Sheets

U.S. PATENT DOCUMENTS

| | | | | |
|---|---|---|---|---|
| 6,234,843 | B1 * | 5/2001 | Pavlovic | 439/620 |
| 6,250,952 | B1 | 6/2001 | Shiga et al. | 439/466 |
| 6,264,508 | B1 | 7/2001 | Lehmann | 439/843 |
| 6,283,794 | B1 | 9/2001 | Osuga | 439/620 |
| 6,425,786 | B1 * | 7/2002 | Scholler | 439/843 |
| 6,435,894 | B1 | 8/2002 | Little et al. | 439/352 |
| 6,439,935 | B1 | 8/2002 | Saka et al. | 439/852 |
| 6,461,184 | B1 * | 10/2002 | Nimura | 439/352 |
| 6,467,165 | B1 * | 10/2002 | Glynn | 29/876 |
| 6,475,039 | B1 | 11/2002 | Despouys | 439/843 |
| 6,799,999 | B1 * | 10/2004 | Williamson et al. | 439/676 |
| 6,837,732 | B1 * | 1/2005 | Pavlovic et al. | 439/352 |
| 2001/0049237 | A1 | 12/2001 | Saka et al. | 439/843 |
| 2001/0051471 | A1 | 12/2001 | Saka et al. | 439/843 |
| 2004/0002248 | A1 | 1/2004 | Glick et al. | 439/352 |

* cited by examiner

ELECTRICAL CONNECTOR CONTACT

CROSS REFERENCE TO RELATED APPLICATIONS

This application claims the benefit under 35 U.S.C. §119 (e) of U.S. provisional patent application No. 60/489,891 filed Jul. 23, 2003 and U.S. provisional patent application No. 60/525,495 filed Nov. 25, 2003 which are hereby incorporated by reference in their entireties.

BACKGROUND OF THE INVENTION

1. Field of the Invention

The present invention relates to electrical connectors and, more particularly, to an electrical connector having a contact with a female connection section.

2. Brief Description of Prior Developments

For a filtered connector intended to be used in a small space, such as an air bag connector, increasing the size of the connector is not desired. U.S. Pat. No. 6,152,775, which is hereby incorporated by reference in its entirety, discloses a filtered electrical connector with multiple ferrite members. There is a desire to provide an electrical contact terminal which can be used with different types of electrical connectors including, for example, an electrical connector having a ferrite tube mounted over the contact terminal, an electrical connector with a capacitive filter circuit attached to the contact terminal, or an electrical connector which does not have a ferrite tube or a capacitive filter circuit.

There is also a desire to provide an electrical connector which can modularly accept a filter assembly, and which can also be used without the filter assembly. There is also a desire to provide a filter assembly with a lead frame and a filter circuit which can be assembled and used as a modular assembly in an electrical connector. There is also the desire to provide a filter assembly with a filter circuit surface mounted on a lead frame with can make a removable surface contact with an electrical connector contact terminal.

SUMMARY OF THE INVENTION

In accordance with one aspect of the present invention, an electrical connector assembly is provided including a housing, electrical contact terminals, a hood and a filter member. The housing is sized and shaped to be plugged into an electrical connector socket of an initiator of a gas generator. A first one of the terminals has a wire connection section and a female connection section. The hood surrounds the female connection section of the first terminal. The hood is a stamped and rolled sheet metal member which has a general tube shape. The filter member is connected to the first terminal for providing electromagnetic induction suppression.

In accordance with another aspect of the present invention, an electrical connector assembly is provided comprising a housing, electrical contact terminals, and a filter member. The housing is sized and shaped to be plugged into an electrical connector socket of an initiator of a gas generator. The housing comprising at least one contact receiving hole. The electrical contact terminals are on the housing. A first one of the terminals has a wire connection section and a female connection section. The first terminal is located in the at least one contact receiving hole. The filter member is connected to the first terminal for providing electromagnetic induction suppression. The first terminal comprises a laterally extending tab. The filter member is electrically connected to the tab.

In accordance with another aspect of the present invention, an electrical connector is provided comprising a housing and an electrical contact connected to the housing. The housing has a portion which is sized and shaped to be inserted into an electrical connector socket of an initiator of a gas generator. The electrical contact comprising a wire connection section, a female connection section, and an internal connecting section. The internal connection section comprises a support and contact tab extending outward in a general cantilevered fashion proximate a base of the female connection section. The support and contact tab forms a stop surface on which a hood can be positioned to position the hood relative to the female connection section. The support and control tab comprises an outer contact tip adapted to be contacted by a spring biased lead of a filter assembly.

In accordance with another aspect of the present invention, an electrical contact assembly is provided comprising an electrical contact terminal and a metal hood. The electrical contact terminal comprises a wire connection section and a female connection section. The female connection section comprises deflectable cantilevered arms, a rear tube section, and cantilevered attachment sections extending from a rear end of the rear tube section. The metal hood comprises a general tube shape with an inwardly rolled front end and a rear end with tabs inwardly deformed onto mounting tabs of the cantilevered attachment sections behind a rear edge of the rear tube section and in front of support tabs of the cantilevered attachment sections. The support tabs extend outward past an outer side of the hood.

In accordance with another aspect of the present invention, an electrical connector is provided comprising a housing, electrical contacts and a filter assembly. The housing has a portion adapted to be inserted into an electrical connector socket of an initiator of a gas generator. A first one of the contacts comprises a sideways outwardly extending contact tab with a contact surface at an outer end of the contact tab. The filter assembly comprises an electrical lead frame with a spring beam and a filter circuit electrically mounted on the lead frame. The lead frame comprises a contact surface at an end of the spring beam which is biased into contact with the contact surface of the contact tab.

In accordance with another aspect of the present invention, an electrical connector filter assembly for assembly into an electrical connector is provided comprising a lead frame and a filter circuit. The lead frame comprises a first contact area, a second contact area, and a spring beam section between the first and second contact areas. The first contact area is adapted to make a wiping surface contact with an electrical contact of the electrical connector. The filter circuit is directly electrically mounted to the lead frame at the second contact area. The filter circuit comprises capacitors and is attached to the lead frame as a modular one-piece unit.

In accordance with another aspect of the present invention, an electrical connector filter assembly for assembly into an electrical connector is provided comprising a lead frame comprising a first contact area, a second contact area; and a filter circuit directly mounted to the lead frame at the second contact area. The filter circuit comprises a plurality of capacitors. The lead frame comprises a hole in the lead frame at the second contact area. The filter circuit is mounted over the hole, and the hole provides an air insulator between the lead frame and a portion of the filter circuit.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
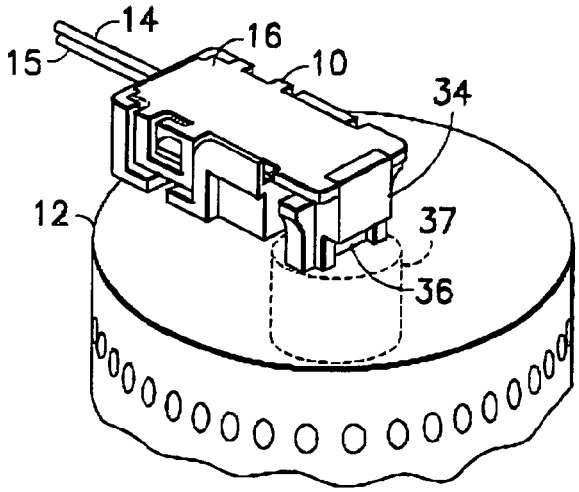
FIG. 1 is a perspective view of an electrical connector incorporating features of the present invention attached to an air bag gas generator.

Referring to FIG. 1, there is shown a perspective view of an exemplary electrical connector 10, incorporating features of the present invention, shown attached to an air bag gas generator 12. In alternate embodiments, the connector 10 could be attached to any suitable type of gas generator or, to any other type of electrical or electronic component. Although the present invention will be described with reference to the exemplary embodiments shown in the drawings, it should be understood that the present invention can be embodied in many alternate forms of embodiments. In addition, any suitable size, shape or type of elements or materials could be used.

Figure 3:
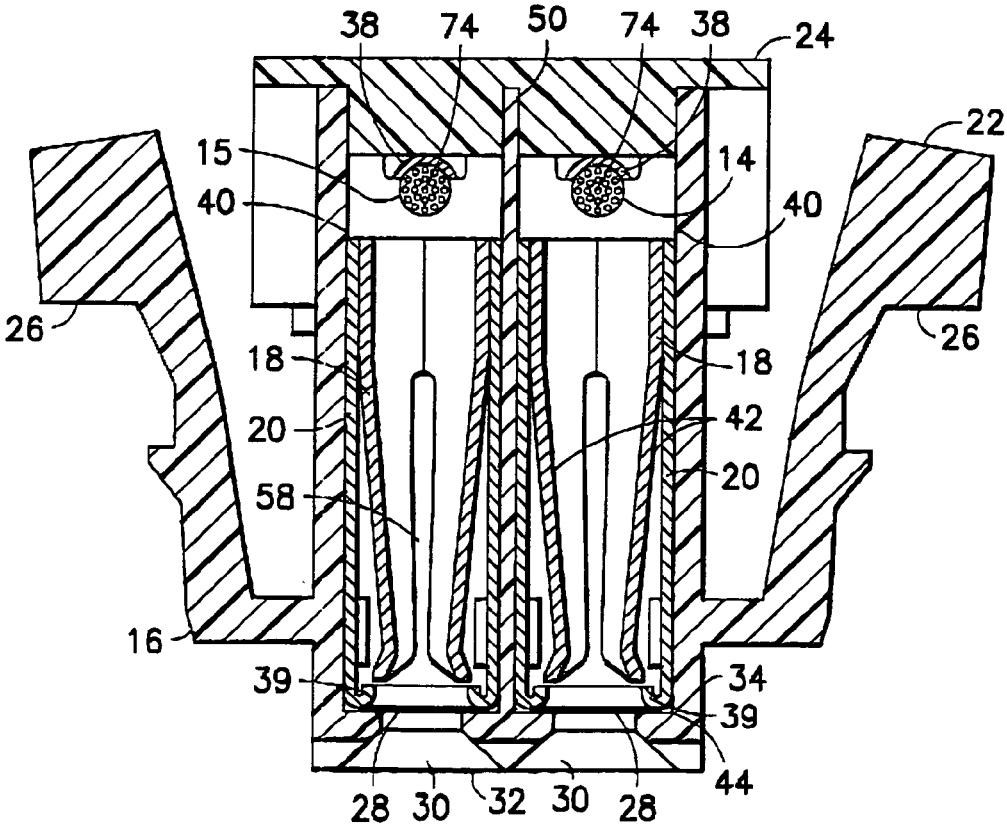
FIG. 3 is a cross-sectional view of the electrical connector shown in FIG. 1.
Figure 2:
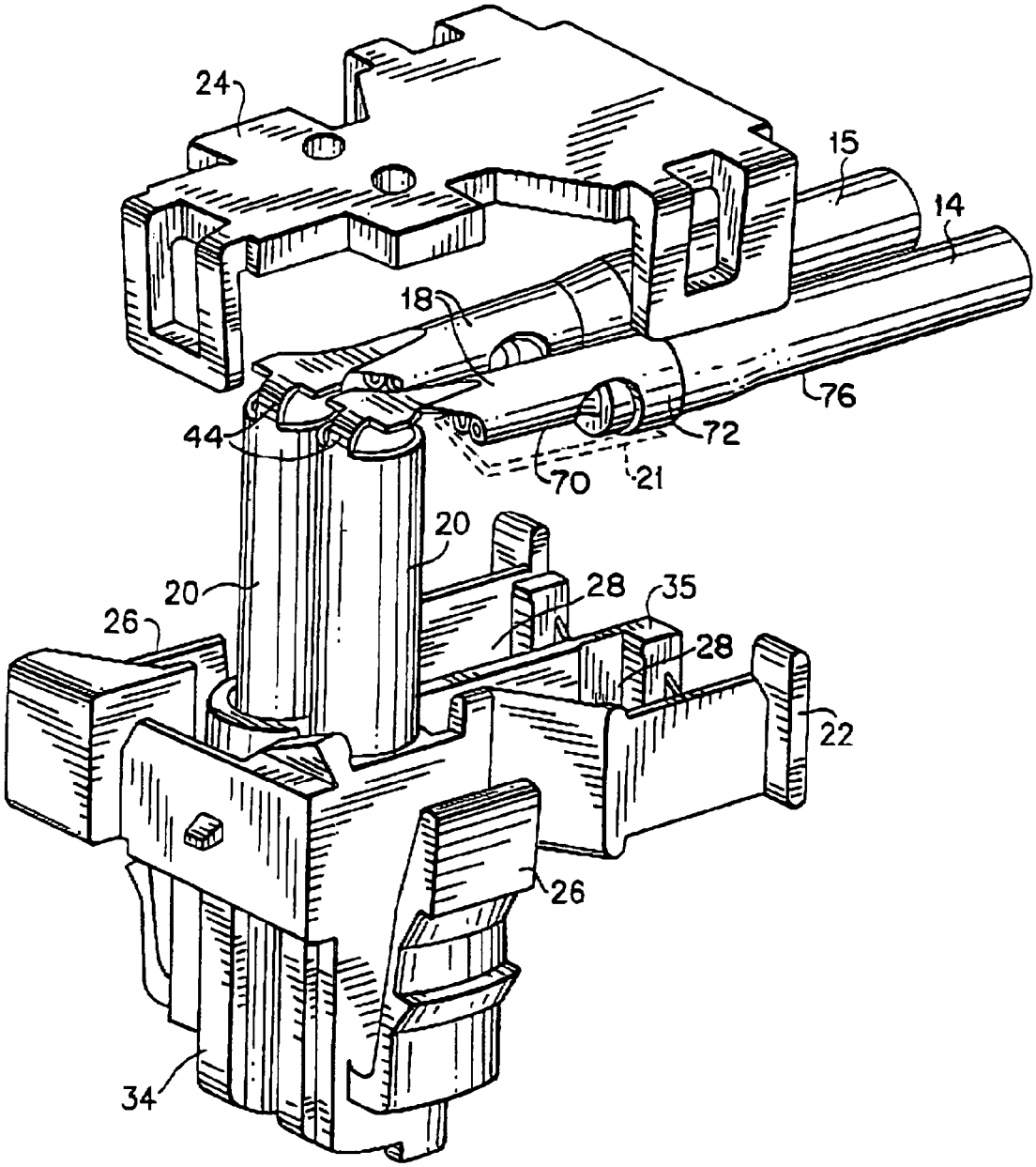
FIG. 2 is an exploded perspective view of the electrical connector shown in FIG. 1.

The connector 10, in this embodiment, is for use in connecting electrical conductors 14, 15 with an initiator 37 in the air bag gas generator 12. Referring also to FIGS. 2 and 3, the connector 10 generally comprises a housing 16, electrical contact terminals 18 and hoods 20. The connector 10 could also comprise a filter assembly 21 (see FIG. 2) or alternatively a ferrite hood(s) or tube(s) (not shown). One type of filter assembly is described in U.S. patent application Ser. No. 10/359,843 which is hereby incorporated by reference in its entirety. However, in alternate embodiments, the connector could additionally comprise one or more ferrite hoods to provide additional filtering as well as the filter assembly 21.

The housing 16 comprises a first housing piece 22 and a second housing piece 24. The two housing pieces are preferably comprised of molded plastic or polymer material. However, in alternate embodiments, any suitable material(s) could be used. In an alternate embodiment, the housing could be comprised of more or less than two housing pieces.

The first housing piece 22 includes two cantilevered finger actuatable deflectable latches 26, two separate receiving areas 28, and two holes 30 through a bottom face 32 of the housing into the receiving areas 28. However, in alternate embodiments, the latches 26 might not be provided. Alternatively, any suitable type of latching system could be provided. The housing 16, at the bottom of the front section 34, is adapted to be plugged into a socket 36 of the initiator 37 of the gas generator 12. The latches 26 are adapted to latch with latch surfaces in the socket 36. Optionally, additional connector position assurance means (not shown) can be provided to prevent the connector 10 from accidentally being disengaged from the gas generator 12. The second housing piece 24 is preferably snap lock mounted onto the first housing piece 22 after the contacts 18 and hoods 20 are located in the receiving areas 28. However, in alternate embodiments, any suitable type of connection could be provided. In addition, in alternate embodiments, other types of housings or housing components could be provided.

Figure 4:
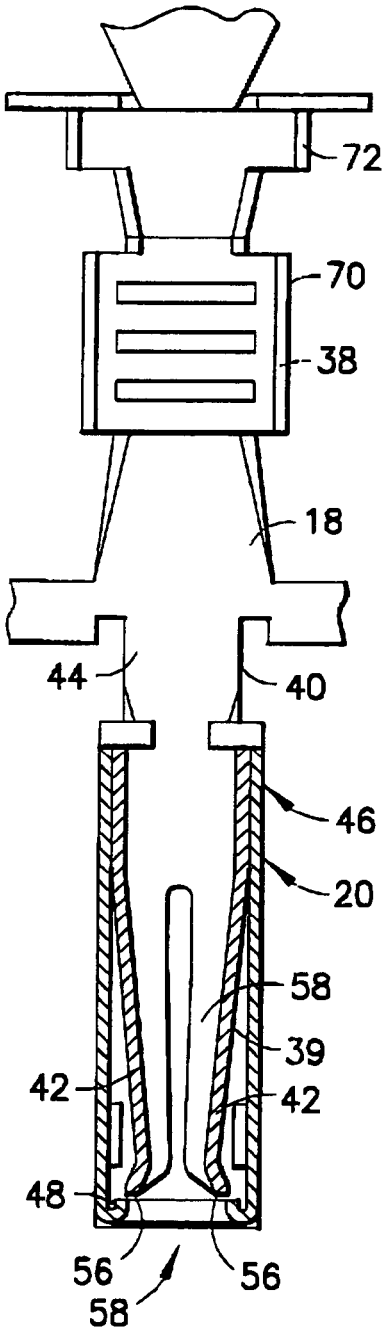
FIG. 4 is a cross sectional view of one of the terminals before attachment to one of the conductors and having one of the hoods connected thereto.

Referring also to FIG. 4, the electrical contact terminals 18 each comprise a first connection section 38, a second female connection section 39, and a positioning section 40. FIG. 4 shows the terminal while still attached to a carry strip and before the positioning section 40 is bent 90 degrees. Each first connection section 38 forms a wire connection section for one of the wires 14, 15. However, in alternate embodiments, the terminals 18 could comprise additional sections, or sections which are shaped differently from the shapes shown in the drawings. Preferably, the contact terminals 18 are comprised of stamped and formed sheet metal. However, in alternate embodiments, the contact terminals could be comprised of any suitable material(s) and/or could be formed by any suitable contact manufacturing process.

The first connection section 38 is provided for forming a wire connection section or lead section for the contact terminal 18. The first connection sections 38 can be crimped onto respective ones of the electrical conductors 14, 15 for connecting the electrical conductors 14, 15 to the contact terminal 18. The wire connection section 38 includes a front portion 70 and a rear portion 72. The front portion 70 is crimped onto the conductor strands 74 of the wire 14 or 15 (see FIG. 3). The rear portion 72 is crimped onto the outer electrical insulation 76 of the wire 14 or 15 (see FIG. 2). However, in alternate embodiments, the first connection section 38 could have any suitable shape. The conductors 14, 15 could be crimped, soldered or welded to the first connection section 38. In the embodiment shown, the first connection section 38 is angled about 90 degrees relative to the second connection section 39. However, the lead section could be straight for an in-line connector.

The positioning section 40 is located between the first connection section 38 and the second connection section 39. In the embodiment shown, the positioning section 40 generally comprises a main shaft section 44 with a 90 degree bend (see FIG. 2) and a tube section 46. In an alternate embodiment, the positioning section could comprise additional or alternative shapes or sections. For example, the positioning section 40 could comprise cantilevered arms. The cantilevered arm(s) could be cantilevered in a downward direction or in a lateral direction from the main shaft section. The main shaft section 44 connects the first connection section 38 to the second connection section 39.

The second female connection section 39 generally comprises two spring contact arms 42. However, in alternate embodiments, the second female connection section could comprise more or less than two spring contact arms or, alternatively, could comprise any suitable type of female shaped connection section. The two spring contact arms 42 extend in a general cantilever fashion from the tube section 46 of the positioning section 40. In the embodiment shown, each spring contact arm 42 comprises a general curved cross-section and are substantially mirror images of each other. Thus, the second connection section 39 forms a general column shape. However, in alternate embodiments, the contact arms could have different shapes and/or could be different from each other.

The general tubular shape of the tube section 46 is coaxially aligned with the center axis of the second connection section 39. However, in alternate embodiments, the positioning section and the second connection section need not be coaxially aligned. The two spring contact arms 42 taper towards each other towards their distal ends 56. The distal ends 56 flair outward to form a male contact entrance area 58. However, as noted above, in alternate embodiments the spring contact arms could comprise any suitable type of shape.

Each hood 20 is preferably comprised of metal, such as stainless steel, copper or other suitable material. The hoods 20 are preferably comprised of flat sheet metal which is stamped and then bent or rolled. Each hood 20 comprises an inwardly bent front end 48. The front end 48 is rolled or bent and then the stock material is rolled or bent into a general column shape as shown. A seam is formed during the rolling process. The seam can be sealed such as by welding, adhesive or a mechanical keying type of connection between the mating edges. However, sealing of the seam is not necessary. Unlike a conventional hood, which is made with a seamless, single cast material, the method of manufacturing the hood 20 described above is less expensive than a casting process and is easier to incorporate into an assembly die.

The hoods 20 assist in positioning the terminals 18 in the receiving areas 28 of the housing. The hoods 20 help to strengthen the second female connection section 39 to allow for more contact force against an inserted metal pin during the final initial stages of insertion of the metal pin for better contact wipe. There would be a relatively significant jump in normal force necessary to open the hood 20. This means that the terminal and hood can improve both positioning of the inserted male contact pin and can help to restore the straight shape of the male contact pin if bent.

A common problem in the art is when the male contact pin becomes bent during manufacture, assembly into a larger device (such as in an automobile assembly line) or attachment to the mating connector. A bent male pin can break a ferrite tube (if a ferrite tube is used in the connector over the hood 20) or cause the male pin to break. The present invention can allow the terminal 18 and hood 20 to straighten the pin back towards its intended shape and location.

Figure 5:
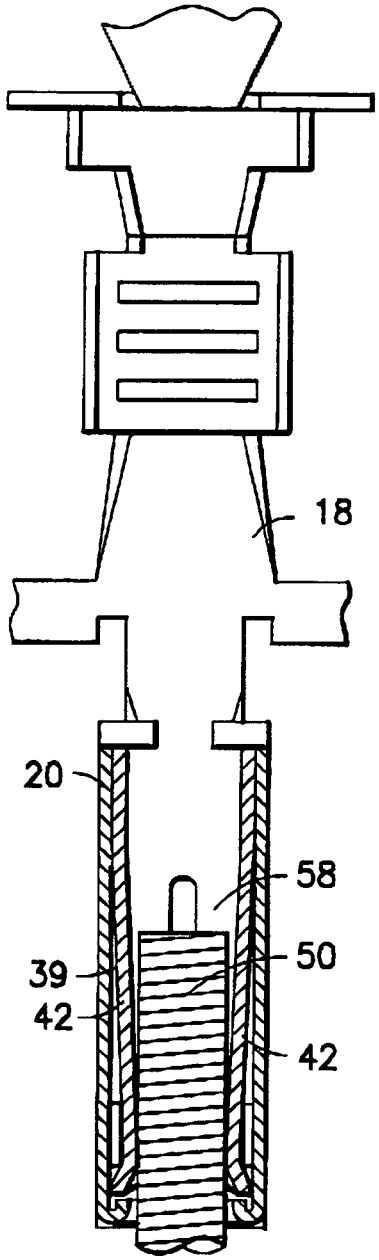
FIG. 5 is a cross sectional view of the terminal and hood shown in FIG. 4 showing insertion of a male contact pin of a mating electrical connector.

Referring now also to FIG. 5, one of the terminals 18 as shown in FIG. 4 is shown with a hood 20 attached and a male contact pin 50 of a mating electrical connector inserted into the contact entrance area 58. When the male contact pin 50 is inserted the ends 56 of the contact arms 42 are wedged apart and contact the interior sides of the hood 20. The rolled front end 48 of the hood 20 helps to maintain the hood 20 as a rigid member. The hood 20, when contacted by the outer sides of the distal ends 56 combine to add rigidity to the contact arms 42 to prevent, or substantially reduce, further outward deflection of the contact arms 42. This allows for increased contact force between the contact arms 42 and the male contact pin 50.

Referring back to FIG. 3, the two receiving areas 28 of the housing are separated by a wall 50 of the housing 16. As seen best in FIGS. 3 and 4, the hoods 20 and the terminals 18 are preferably sized and shaped to provide a gap between the second female connection sections 39 of the terminals 18 and the interior sides of the hoods 20. This allows for a limited amount of lateral movement or lateral rocking of the second female connection sections 39 in the receiving areas 28 for self alignment relative to the housing. However, the housing 16 and terminals 18 preferably do not allow forward or rearward movement of the second female connection sections 39 in the receiving areas 28. In an alternate embodiment, a ferrite hood could be provided around the exterior side of one or both of the hoods 20. However, the ferrite hood does not need to be as thick as conventional ferrite hoods because the hood 20 provides structural reinforcing or support for the terminals. Therefore, the ferrite hoods do not need to provide this structural support or reinforcing.

The ferrite material, if provided, does not need to be rigid. With the present invention, the ferrite tube (if used around the hood 20) no longer needs to function as a guide for the terminal. The hood 20 can now provide the guide function. Thus, there is less risk of damage to the ferrite tube; even if the wall thickness of the ferrite tube needs to be reduced 10–15 percent to accommodate the hood 20 is the same real estate or footprint.

Figure 6:
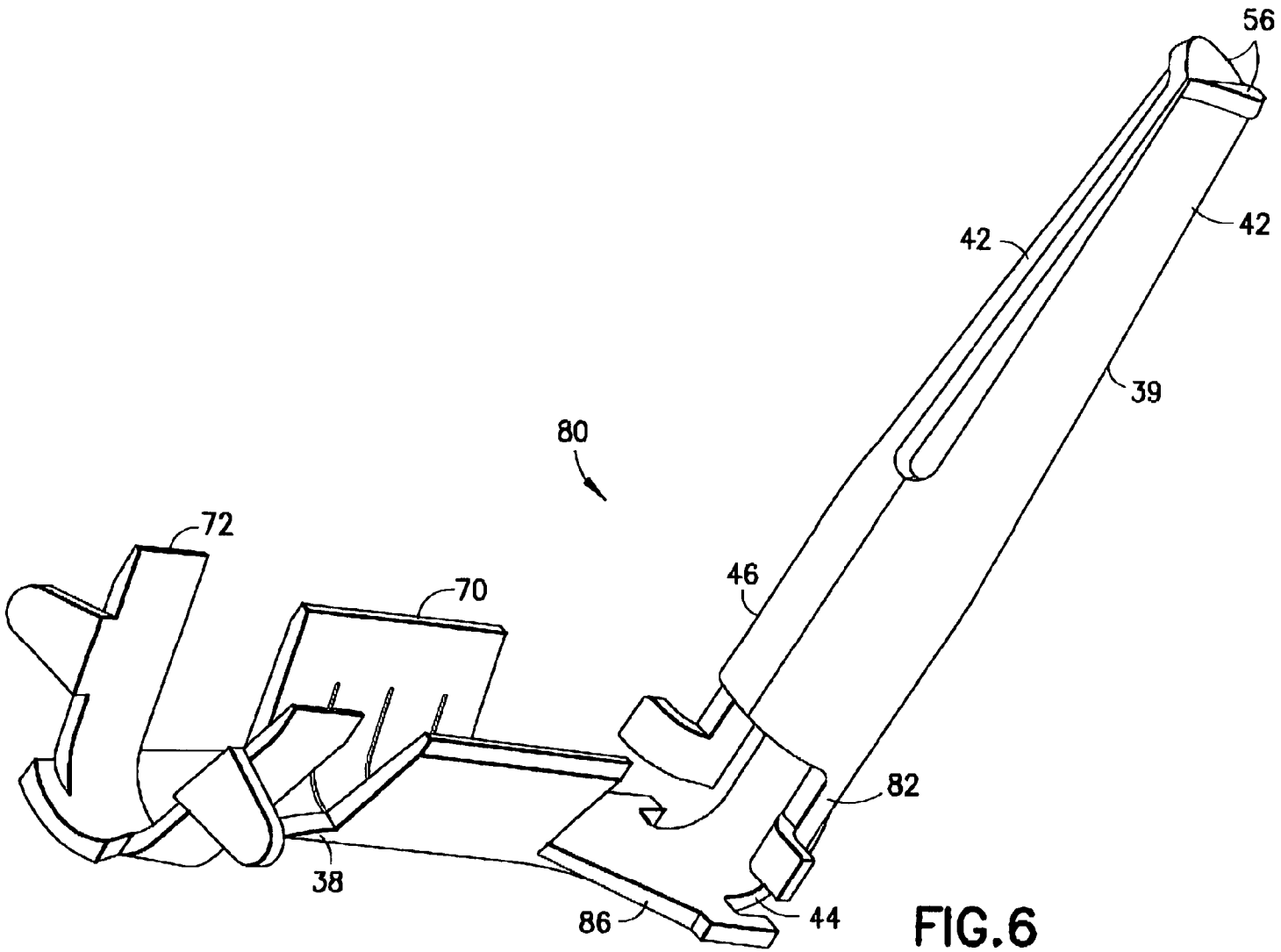
FIG. 6 is a perspective view of an alternate embodiment of the terminal shown in FIGS. 4 and 5.

Referring now to FIGS. 6–11, an alternate embodiment of the present invention will be described. FIG. 6 shows a perspective view of the terminal or contact 80 for use with the housing shown in FIGS. 1–3. The terminal 80 is comprised of a single metal member which is formed from flat sheet metal stock material. The terminal 80 is substantially identical to the terminal 18 shown in FIGS. 3–5. However, the terminal 80 includes an attachment section or internal connecting section 82 for fixedly attaching the hood 84 (shown in FIG. 9) to the terminal.

The electrical contact terminal 80 comprises the first connection section 38, the second female connection section 39, and a positioning section 86. The positioning section 86 comprises the attachment section 82. The first connection section 38 forms a wire connection section for one of the wires 14, 15. Preferably, the contact terminal 80 is comprised of stamped and formed sheet metal. However, in alternate embodiments, the contact terminals could be comprised of any suitable material(s) and/or could be formed by any suitable contact manufacturing process.

The wire connection section 38 includes a front portion 70 and a rear portion 72. The front portion 70 is crimped onto the conductor strands 74 of the wire 14 or 15. The rear portion 72 is crimped onto the outer electrical insulation 76 of the wire 14 or 15. The first connection section 38 is angled about 90 degree s relative to the second connection section 39. However, the lead section could be straight for an in-line connector.

The positioning section 86 is located between the first connection section 38 and the second connection section 39. In the embodiment shown, the positioning section 86 generally comprises a main shaft section 44 with a 90 degree bend the tube section 46, and the attachment section 82. The positioning section 86 connects the first connection section 38 to the second connection section 39.

In the embodiment shown, the second female connection section 39 generally comprises two spring contact arms 42. However, in alternate embodiments, the second female connection section could comprise more than two spring contact arms or, alternatively, could comprise any suitable type of female shaped connection section. The two spring contact arms 42 extend in a general cantilever fashion from the tube section 46 of the positioning section 86. In the embodiment shown, each spring contact arms 42 comprises a general curved cross-section and are substantially mirror images of each other. Thus, the second connection section 39 forms a general column shape. However, in alternate embodiments, the contact arms could have different shapes and/or could be different from each other.

Figure 7:
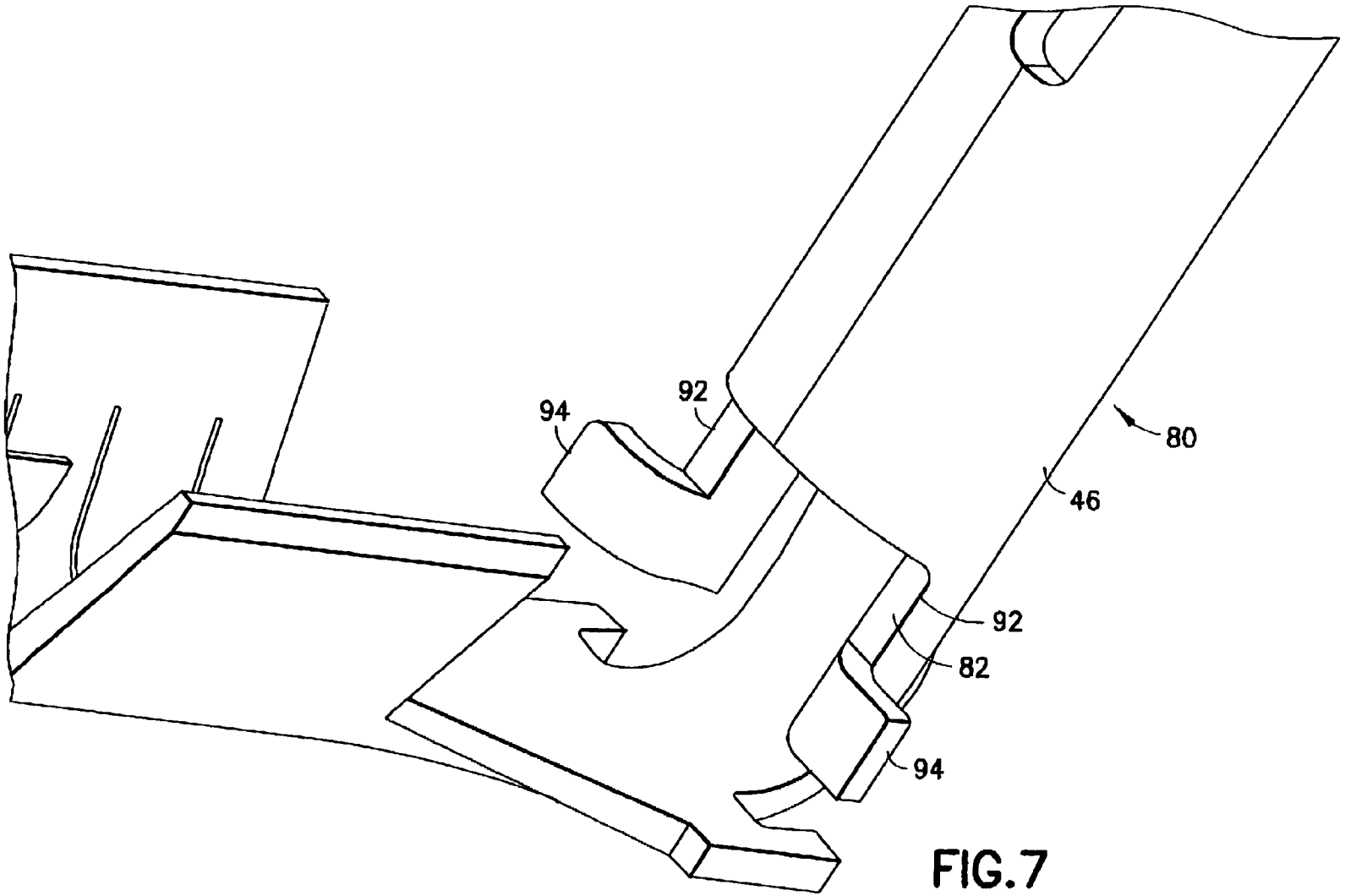
FIG. 7 is an enlarged partial perspective view of the terminal shown in FIG. 6.
Figure 8:
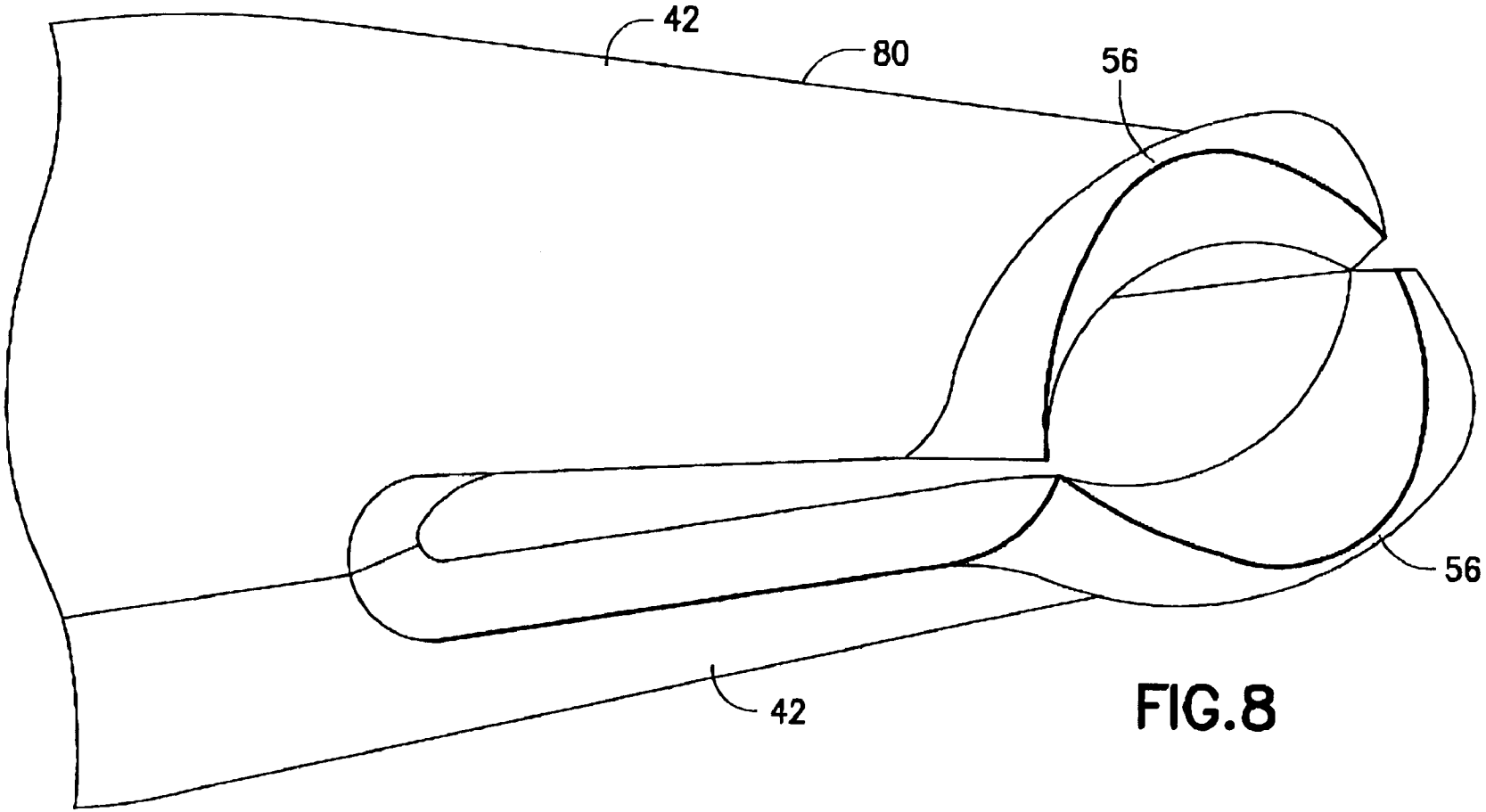
FIG. 8 is an enlarged partial perspective view of the front end of the terminal shown in FIG. 6.
Figure 9:
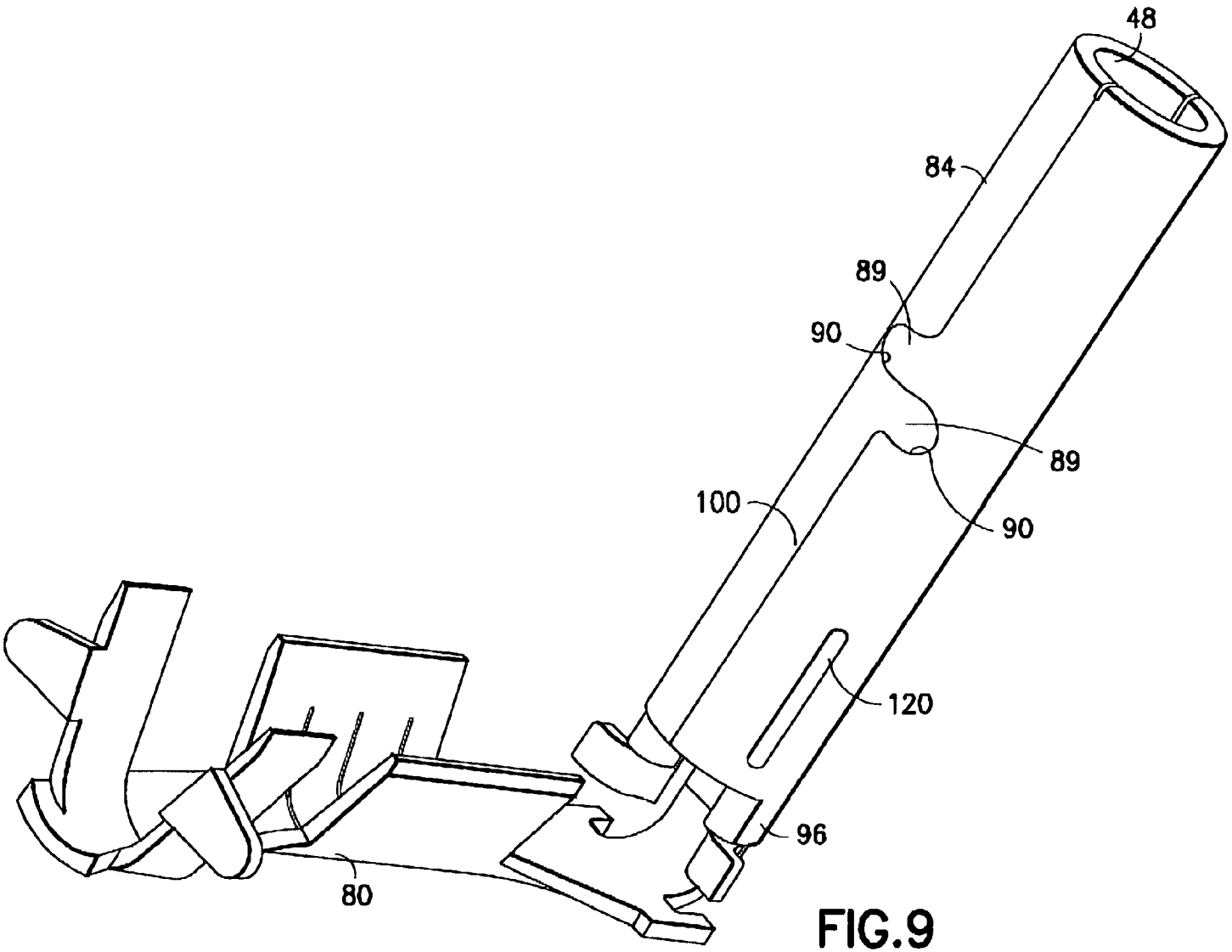
FIG. 9 is a perspective view of the terminal shown in FIG. 6 having a hood attached thereto to form an assembly.
Figure 10:
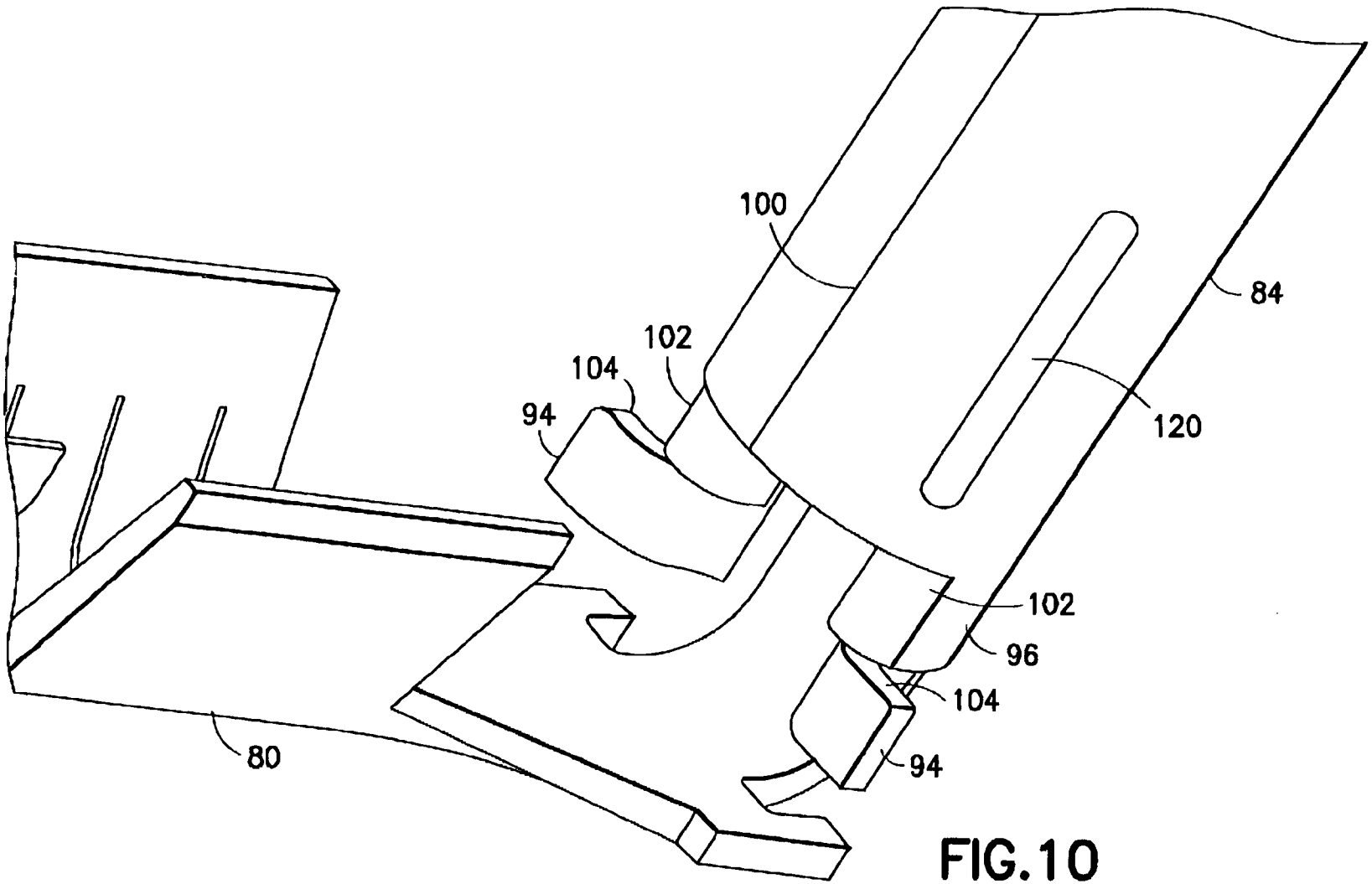
FIG. 10 is an enlarged perspective view of portions of the hood and terminal shown in FIG. 9 showing a mechanical connection of the hood to the terminal at attachment sections.

As seen best in FIG. 7, the attachment section 82 comprises two mounting tabs 92 and two support and contact tabs 94 located at ends of the mounting tabs 92. The mounting tabs 92 extend from a rear end of the tube section 46 in a general cantilevered fashion. The support tabs 94 extend laterally outward from the mounting tabs 92. Referring also to FIGS. 9 and 10, the hood 84 is shown attached to the terminal 80. The hood 84 is substantially identical to the hood 20, but includes an attachment section 96 at its rear end.

The hood 84 is preferably comprised of metal, such as stainless steel, copper or other suitable material. The hood 84 is preferably comprised of flat sheet metal which is stamped and then bent or rolled. The hood 84 comprises an inwardly bent front end 48. The front end 48 is rolled or bent and then the stock material is rolled or bent into a general column shape as shown. As seen best in FIG. 11, the front end 48 creates a reduced size entrance aperture to the ends 56 of the terminal. The front end 48 can, thus, function as a guide for the male contact pin into the female contact section. An extra slot 98 can be provided to accommodate the dual rolled or compound rolled shape at the front end 48.

A seam 100 is formed during the rolling process. The seam can be sealed such as by welding, adhesive or a mechanical keying type of connection between the mating edges. The seam 100, in the embodiment shown in FIG. 9, is located at opposing edges of the seam and has interlocking projections 89 and recesses 90. However, sealing of the seam is not necessary. The hood 20 assists in positioning the terminal 80 in a receiving area of the housing. The hood 84 helps to strengthen the second female connection section 39 to allow for more contact force against an inserted metal pin during the final initial stages of insertion of the metal pin for better contact wipe.

Figure 11:
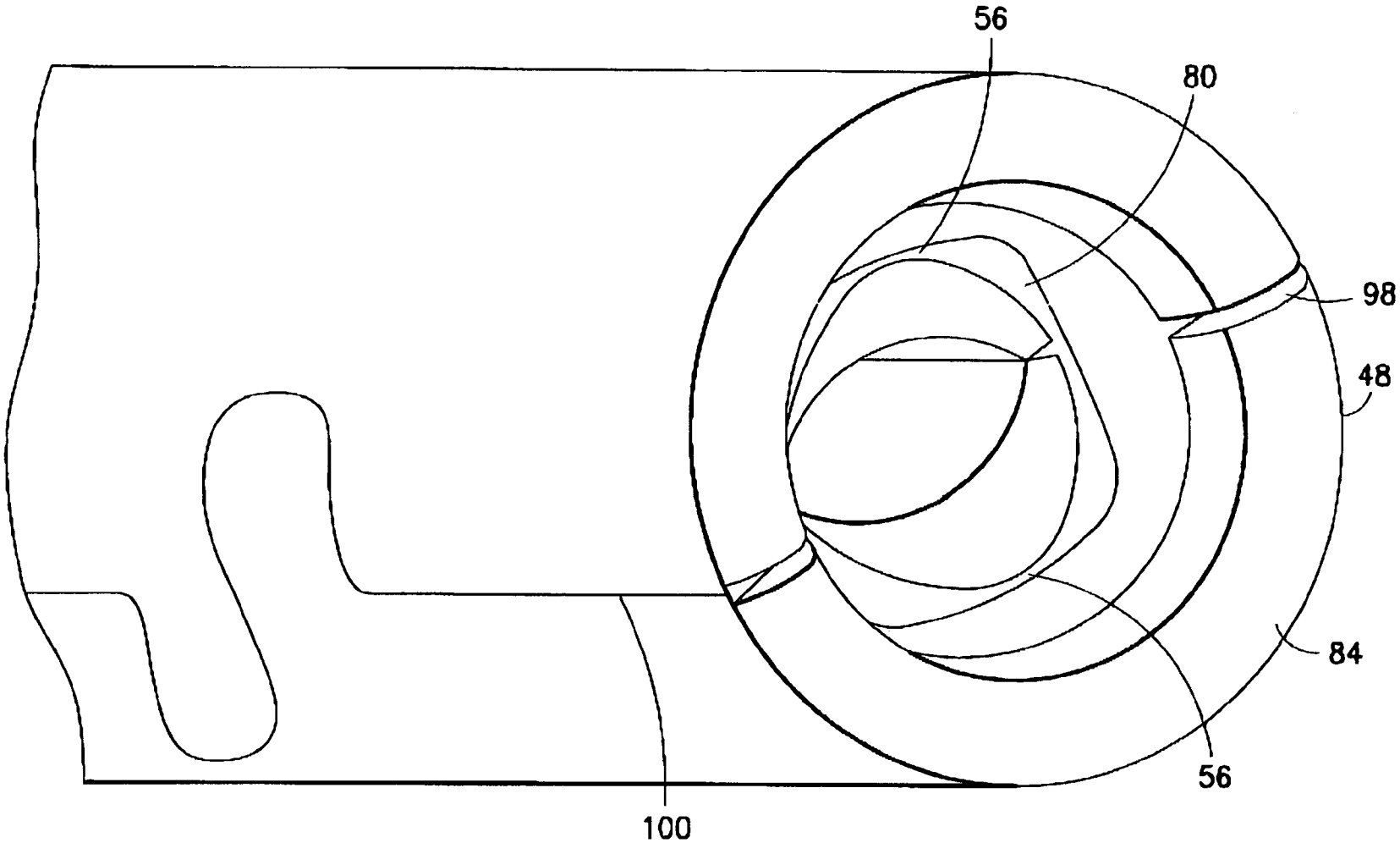
FIG. 11 is an enlarged perspective view of front portions of the hood and terminal shown in FIG. 9.

The attachment section 96 comprises two mounting tabs 102. The mounting tabs 102 are located against the front sides 104 and are then bent inward to mount onto the mounting tabs 92. The mounting tabs 102 are captured between the front sides 104 and the tube section 46 to substantially longitudinally fix the tube 84 on the terminal 80. In alternate embodiments, any suitable type of connection between the terminal 80 and the tube 84 could be provided. As seen in FIG. 11, the distal ends 56 of the contact arms 42 are located behind the inwardly curved front end 48 of the hood 84. This insures that the front end 48 will not interfere with the outward movement of the distal ends 56 when the male contact pin is inserted. Thus, the attachment of the hood 84 to the contact 80 described above insurers a relatively precise longitudinal positioning of the hood on the terminal to prevent interference with movement of the distal ends 56 of the terminal. If desired, the mounting tabs 102 can be straightened to allow the hood 84 to be removed from the terminal.

The attachment of the hood to the terminal by the tabs also helps to prevent rotation and tilting of the hood relative to the terminal. Preferably, there is no looseness of the hood on the terminal. All degrees of freedom are removed.

In a preferred embodiment, the male contact pin 50 has an outer diameter of approximately 1 mm. Each contact arms 42 of the terminal 18, 80 has a thickness of approximately 0.2 mm. The hood 20, 84 has an inner diameter of about 1.4 mm. Each flared end 56 of the contact arms 42 is about 0.25 to about 0.28 mm. These dimensions can lead to a unique feature. Conventional art relating to air bag terminals does not include deflecting the arms of the terminals (i.e., when the male contact pin is inserted into the female connection section) such that the contact arms (or flared ends of the arms) touch an inner surface of the hood. With the present invention, on the other hand, the contact arms of the terminals touch the inner surface of the hood when the male contact pin is inserted into the female connection section. This arrangement allows the hood to provide a normal restoring force against the arms, which helps hold the pin in place.

The mounting tabs 102 can have an exemplary width of about 0.5 mm or greater. The body of the terminal (positioned between the crimping end of the terminal and the arms of the terminal) define a cylindrical outer surface having a constant outer diameter. The surface 104 can also function as a stop surface for a ferrite tube mounted over the outside of the hood 20. This can prevent the ferrite tube from being located at the 90 degree bend at 44 which is more prone to damage the ferrite tube.

The hood has a larger contact area with a ferrite tube than in conventional filtered connectors having ferrite tubes. Because of this increased contact area, the system can have better filtering. The hood preferably has an interference fit with the terminal. As seen in FIGS. 9 and 10, the hood can be stamped to form three inwardly extending ribs 120. The ribs 120 are located around the hood and contact the terminal to stabilize connection of the hood with the terminal and provide an interference fit.

The hood component can protect the terminal during insertion of a male pin. The hood can protect terminal beams in the process of connector assembly. The hood can also guide the male contact pin. At maximum deflections of the terminal beams, the terminal beams can contact the hood and it will generate additional force. The connector housing can tightly guide the tip of the terminal hood. The hooded terminal and a ferrite tube can fit into the same opening as a prior art plastic housing. This can provide the advantage of not having to rework or redesign the housing.

The new terminal can have shorter and smaller diameter beams, but generate larger normal force at the similar stress. The hood material can be similar or dissimilar to the terminal material. The hood can provide enhanced EMI protection to the connector through greater effective length between the hood and the ferrite tube. The hood could have a tab on the side of each terminal beam. The tab would be made to extend off the hood body and could be connected to the body in a manner that would allow it to function as a spring beam. At maximum terminal beam deflections, the beam tip could run into a tab and be deflected. It could generate additional force. The hood could be made to extend off the terminal material so that the final terminal will be a one-piece stamping. In addition, the hood of a one-piece terminal could be folded back to better protect terminal beams.

Figure 12:
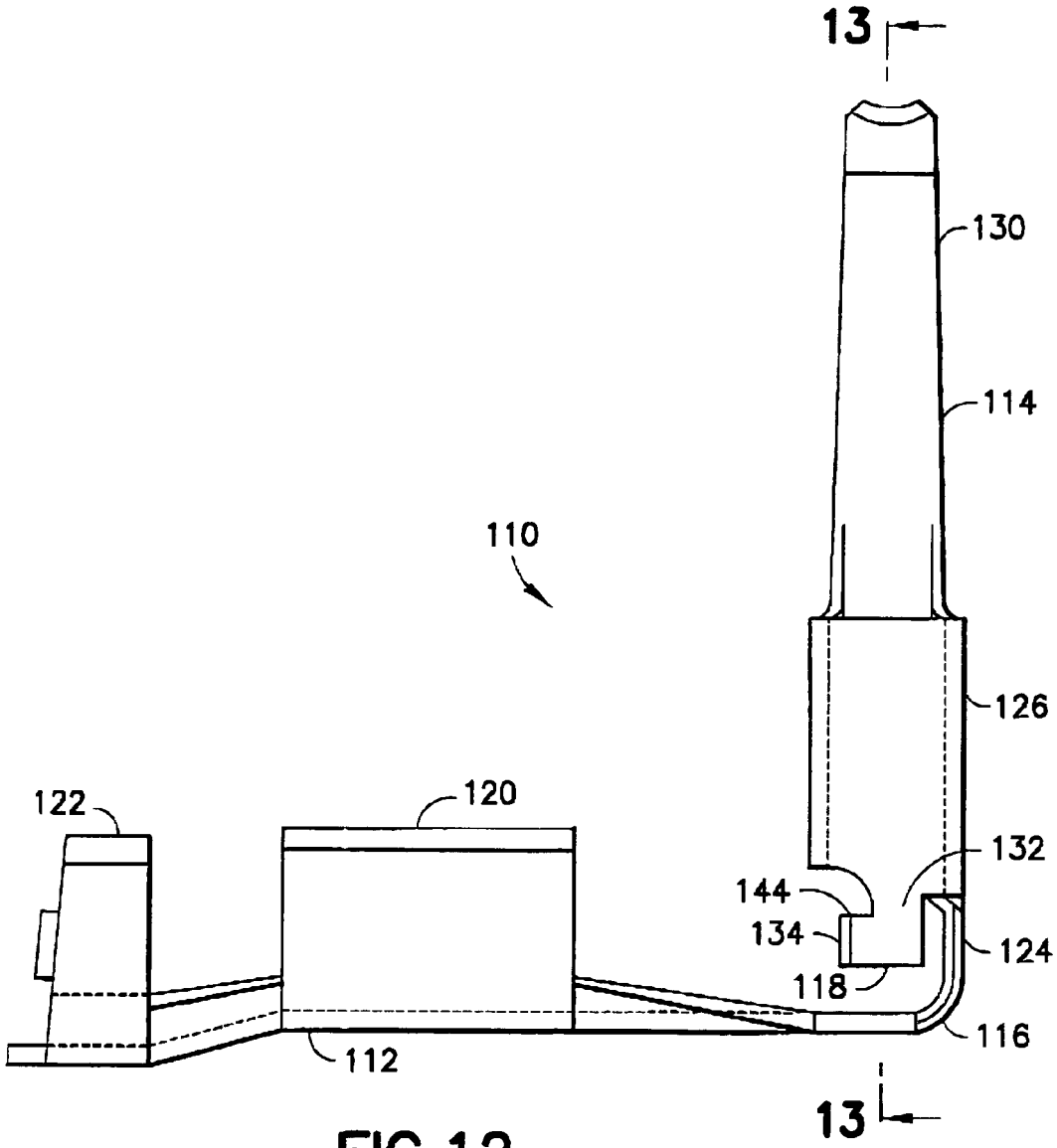
FIG. 12 is an elevational side view of an alternate embodiment of a terminal incorporating features of the present invention.
Figure 13:
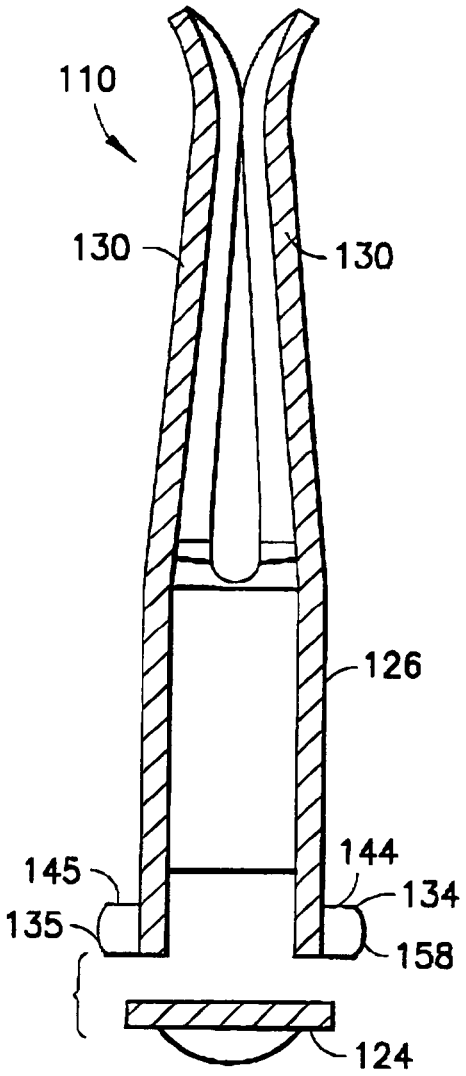
FIG. 13 is a cross sectional view of the terminal shown in FIG. 12 taken along line 13—13.

Referring now to FIGS. 12 and 13, an alternate embodiment of the terminal is shown. The terminal 110 is preferably comprised of a single metal member which is formed from flat sheet metal stock material. The terminal or contact 110 is for use with the housing shown in FIGS. 1–3, but could be used with other sizes and shapes of housings. In this embodiment the terminal 110 generally comprises a first connection section 112, a second female connection section 114, and a positioning section 116. The positioning section 116 comprises an attachment section 118. The first connection section 112 forms a wire connection section for one of the wires 14 or 15. Preferably, the contact terminal 110 is comprised of stamped and formed sheet metal. However, in alternate embodiments, the contact terminals could be comprised of any suitable material(s) and/or could be formed by any suitable contact manufacturing process.

The wire connection section includes a front portion 120 and a rear portion 122. The front portion 120 is crimped onto the conductor strands of the wire 14 or 15. The rear portion 122 is crimped onto the outer electrical insulation of the wire 14 or 15. The first connection section 112 is angled about 90 degree s relative to the second connection section 114. However, the lead section could be straight for an in-line connector.

The positioning section 116 is located between the first connection section 112 and the second connection section 114. In the embodiment shown, the positioning section 116 generally comprises a main shaft section 124 with a 90 degree bend, a tube section 126, and the attachment section 118. The positioning section 116 connects the first connection section 112 to the second connection section 114.

Figure 20:
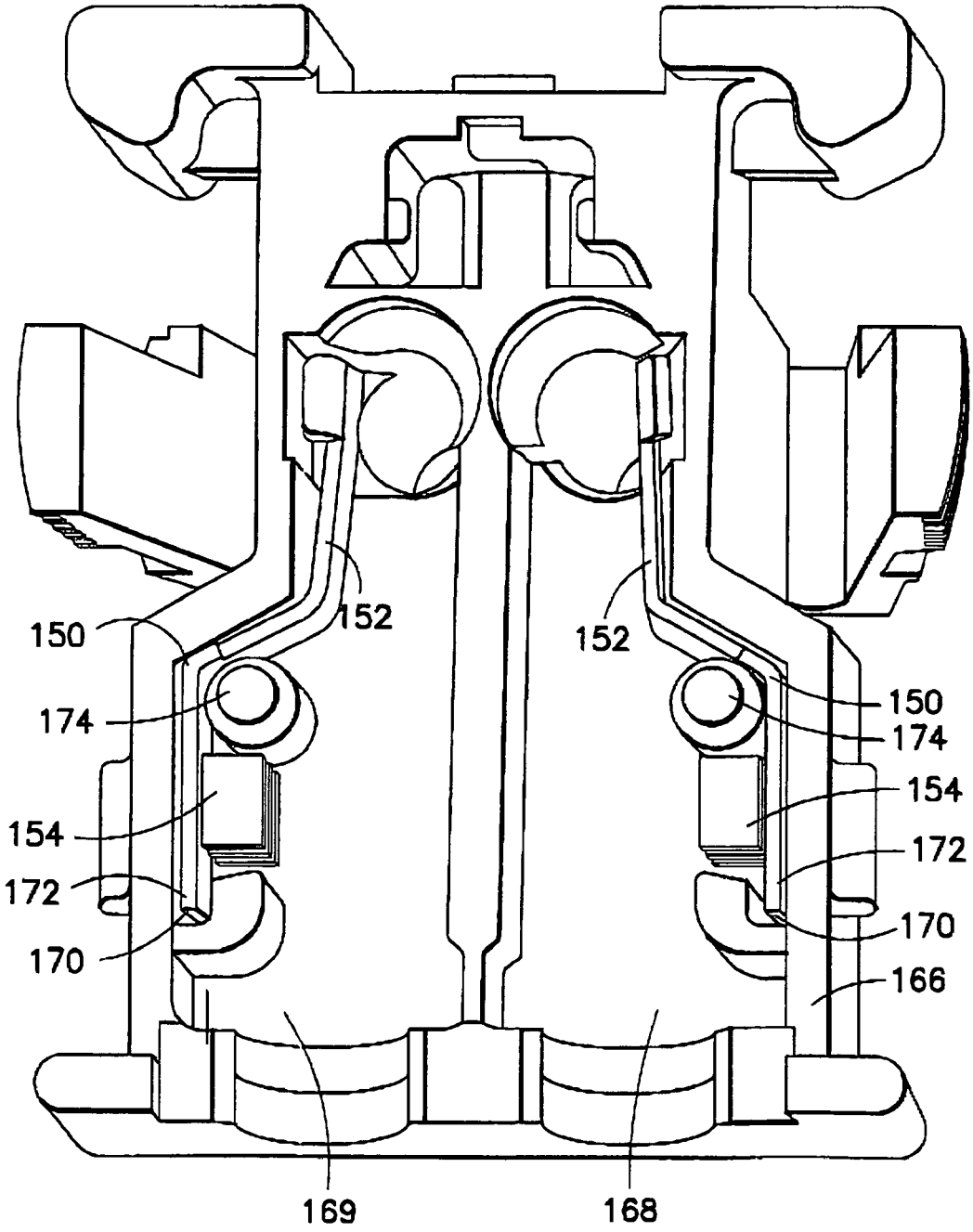
FIG. 20 is a top perspective view of one member of a connector housing having two of the filter assemblies of FIG. 19 mounted thereto.

In the embodiment shown, the second female connection section 114 generally comprises two spring contact arms 130. However, in alternate embodiments, the second female connection section could comprise more than two spring contact arms or, alternatively, could comprise any suitable type of female shaped connection section. The two spring contact arms 130 extend in a general cantilever fashion from the tube section 126 of the positioning section 116. In the embodiment shown, each spring contact arm 130 comprises a general curved cross-section and the spring contact arms are substantially mirror images of each other. Thus, the second connection section 114 forms a general column shape. However, in alternate embodiments, the contact arms could have different shapes and/or could be different from each other. The attachment section 118 comprises two mounting areas 132 and two support and contact tabs 134, 135 located at rear sides of the mounting areas 132. The mounting areas 132 are located at a bottom end of the tube section 126. The support and contact tabs 134, 135 extend generally rearward and then laterally outward from the mounting areas 132. In the embodiment shown, the first tab 134 is the same length as the second tab 135 such that two of the terminals can be used as both terminals of the connector; each capable of contacting a filter assembly on respective right and left sides of the connector as shown in FIG. 20 (see also FIG. 21). The end 158 is preferably curved to function as a contact beam which can wipe against another member as also described below with reference to FIGS. 17 and 18.

Figure 14:
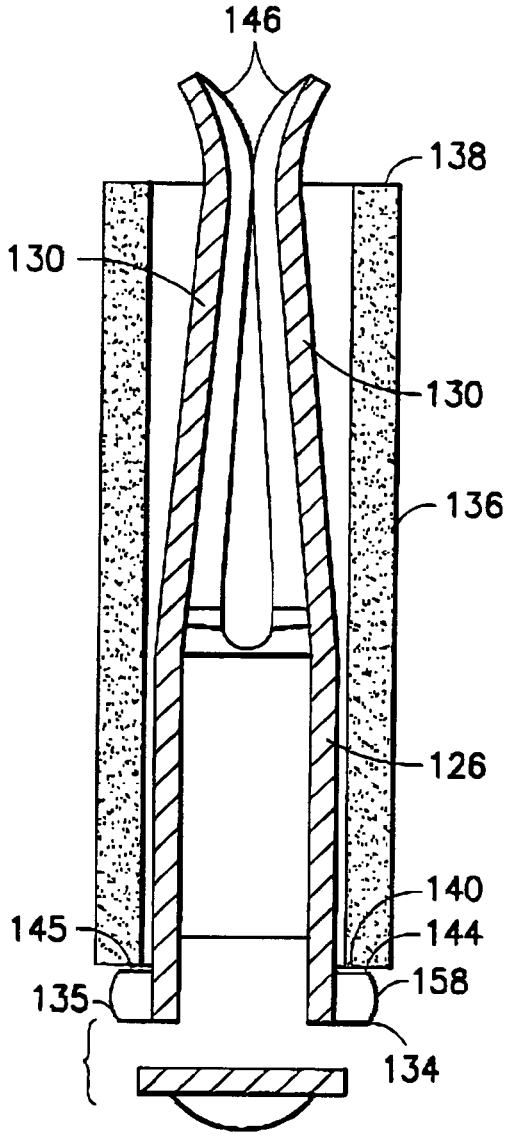
FIG. 14 is a cross sectional view of the terminal as shown in FIG. 13 having a ferrite tube mounted on the terminal.

Referring also to FIG. 14, a ferrite tube 136 is shown attached to the terminal 110. The tube 136 is preferably comprised of ferrite oxide, such as disclosed in U.S. Pat. No. 6,152,775 which is hereby incorporated by reference in its entirety. The tube 136 has an inner diameter which is sized and shaped to receive the tube section 126 and contact arms 130 therein. In the embodiment shown, the length of the tube is shorter than the length of the tube section 126 and contact arms 130 such that the end tips 146 of the contact arms 130 extend past the front end 138 of the tube 136. The rear end 140 of the tube 136 is adapted to be placed against the top surfaces 144, 145 of the tabs 134, 135. Thus, the tabs 134, 135 can function as supports for supporting the tube 136 and positioners to position the tube above the bend in the terminal at the main shaft 124. This reduces the risk that the tube, which is relatively brittle, might become damaged or break at the bend.

Figure 15:
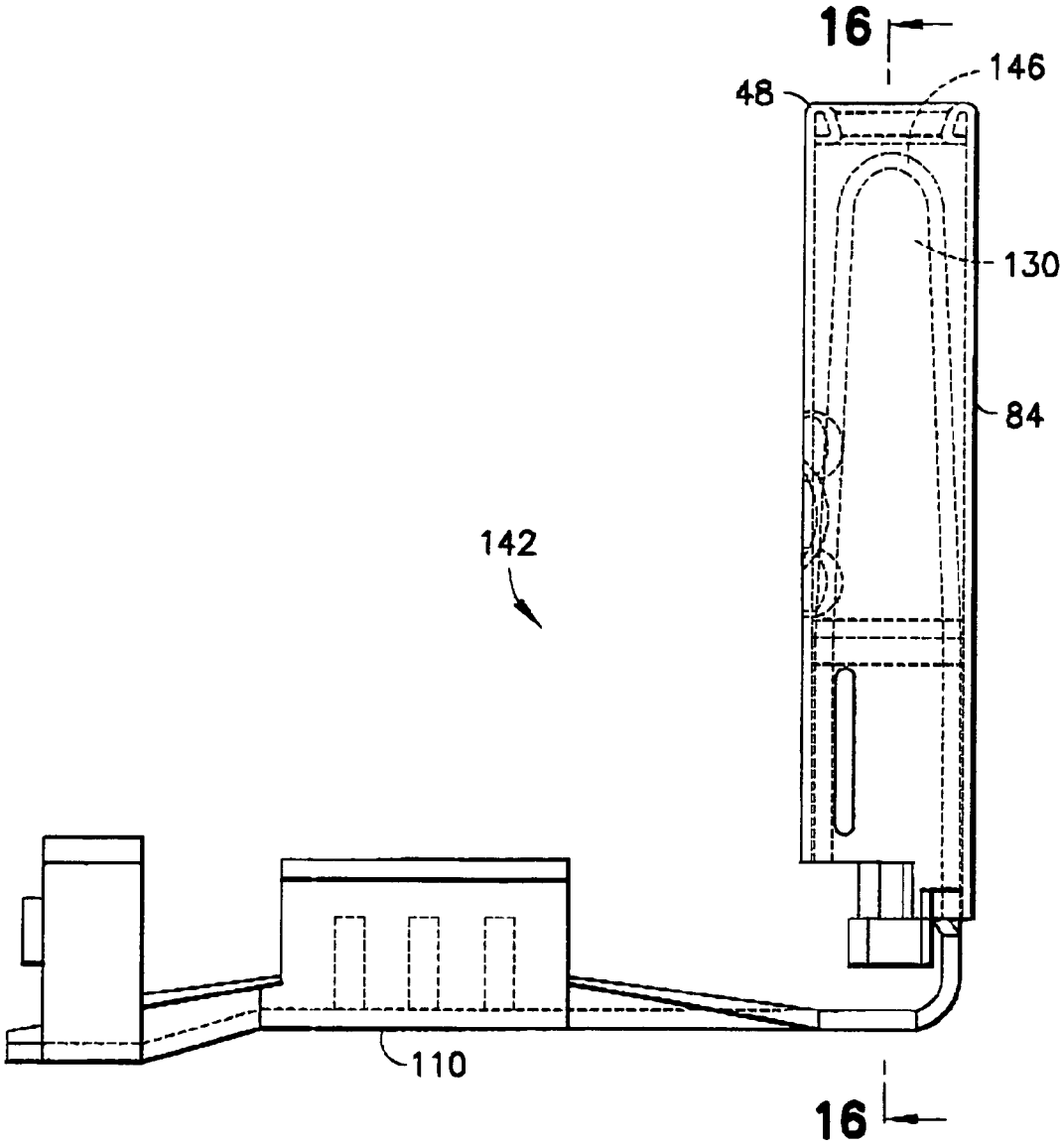
FIG. 15 an elevational side view of an assembly of the terminal shown in FIG. 12 connected to the hood shown in FIGS. 9 and 10.

Referring now also to FIG. 15, another alternate embodiment of the present invention is shown. In this embodiment, the terminal 110 has the hood 84 attached to the terminal to form an assembly 142. The mounting tabs 102 are bent inward onto the mounting areas 132 to attached the hood 84 to the terminal 110. The mounting tabs 102 of the hood 84 are located against the top sides 144, 145 of the tabs 134, 135 and are then bent inward to mount onto the mounting areas 132. The mounting tabs 102 are captured between the front sides 144, 145 and the tube section 126 to substantially longitudinally fix the tube 84 on the terminal 110. In alternate embodiments, any suitable type of connection between the terminal 110 and the tube 84 could be provided.

This embodiment helps to illustrate that the terminal 110 can be used in multiple different types of connectors. More specifically, the terminal 110 can be used in a filtered connector which uses a ferrite tube and does not have the hood 84, such as shown in FIG. 14, or a connector which has a hood as shown in FIG. 15. This allows the terminal 110 to be used in at least two different types of electrical connectors.

As seen in FIG. 15, the distal ends 146 of the contact arms 130 are located behind the inwardly curved front end 48 of the hood 84. This insures that the front end 48 will not interfere with the outward movement of the distal ends 146 when the male contact pin is inserted. Thus, the attachment of the hood 84 to the contact 110 described above insurers a relatively precise longitudinal positioning of the hood on the terminal to prevent interference with movement of the distal ends 146 of the terminal, except at the final stage of movement of the distal ends 146 when they can contact the inside surfaces of the hood. If desired, the mounting tabs 102 can be straightened to allow the hood 84 to be removed from the terminal. The attachment of the hood to the terminal by the tabs also helps to prevent rotation and tilting of the hood relative to the terminal. Preferably, there is no looseness of the hood on the terminal. All degrees of freedom are removed.

Figure 16:
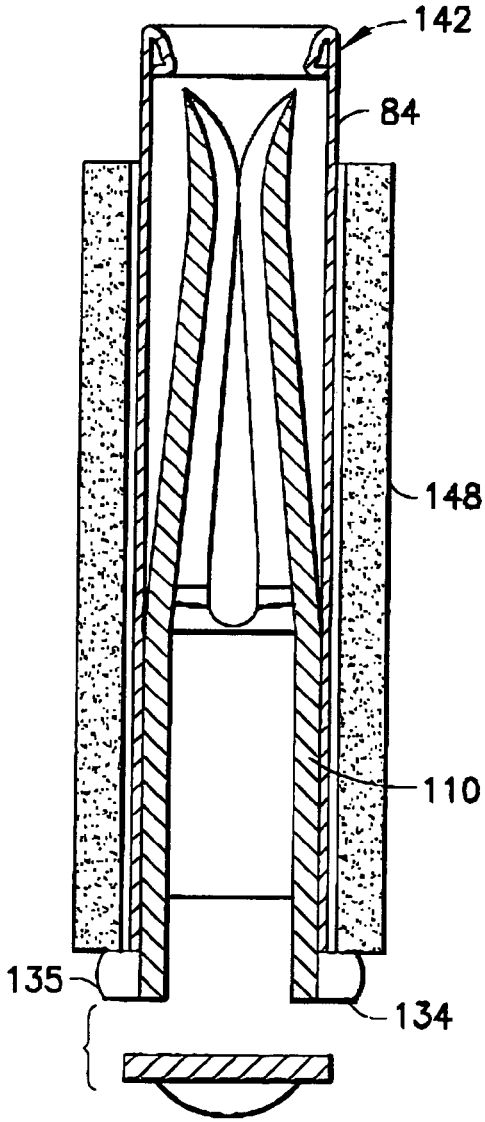
FIG. 16 is a cross sectional view of the assembly of FIG. 15 having a ferrite tube mounted thereon.

As noted above, the terminal 110 can be used in a filtered connector which uses a ferrite tube and which does not have the hood 84, such as shown in FIG. 14, or a connector which has a hood as shown in FIG. 15. Referring also to FIG. 16 one embodiment of use of the assembly 142 of FIG. 15 is shown for a filtered connection. In this embodiment, the assembly 142 is used with a ferrite tube 148. The ferrite tube 148 has a slightly larger inner diameter to accommodate the outer diameter of the assembly 142. This illustrates that the assembly 142 can be used with a ferrite tube. More specifically, the terminal 110 can be used with both a ferrite tube 148 and a hood 84. The tabs 134, 135 can be used to locate and support both the ferrite tube 148 and the hood 84. No electrical connection is needed for the ferrite tubes.

Figure 18:
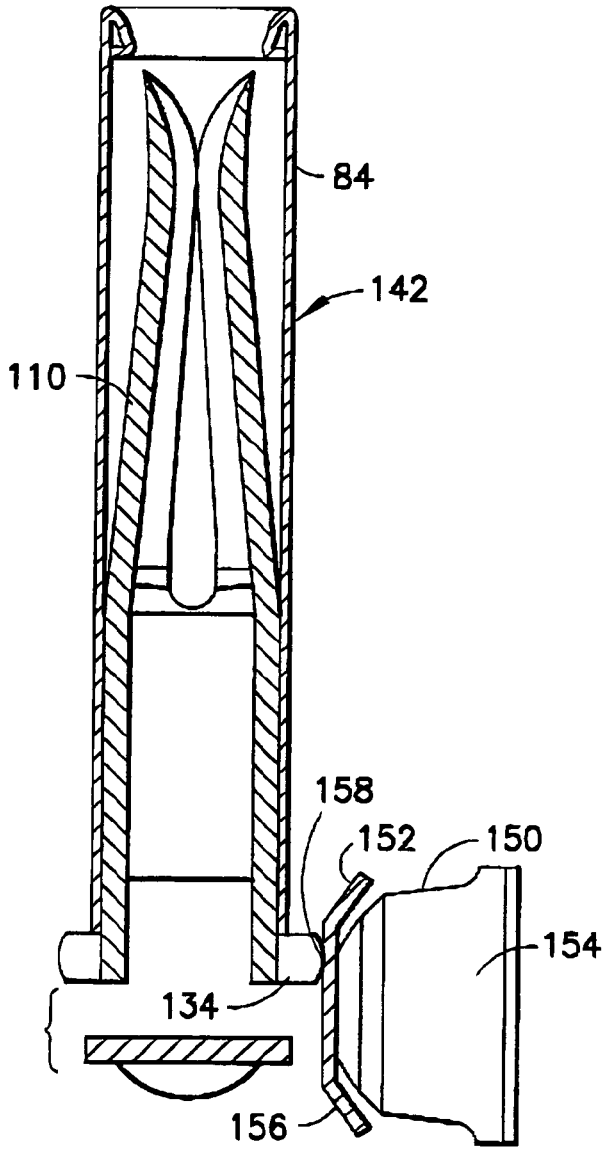
FIG. 18 is a cross sectional view of the assembly and filter assembly shown in FIG. 17 taken along line 18—18.
Figure 17:
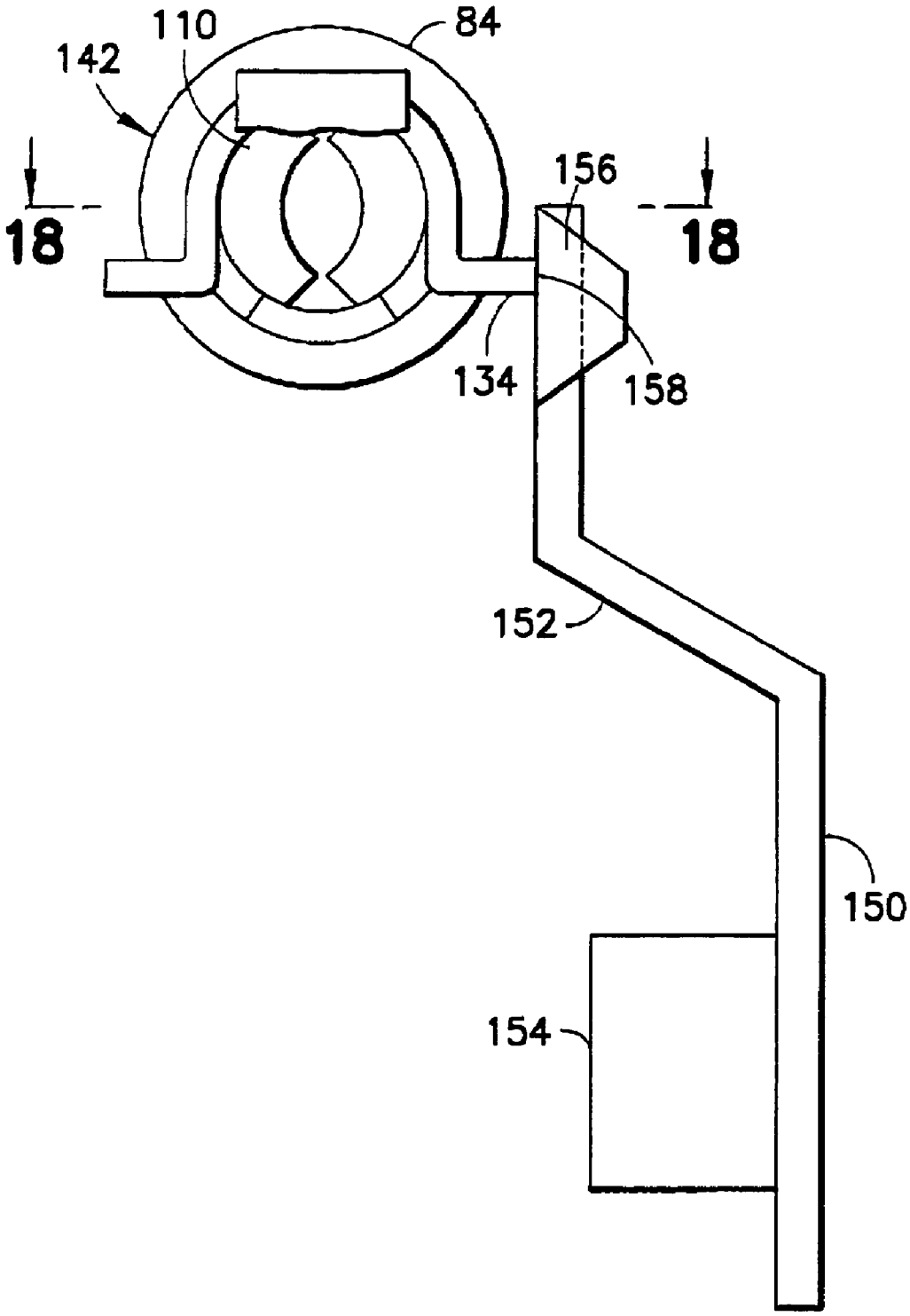
FIG. 17 is a top plan view of the assembly shown in FIG. 15 connected to a filter assembly.

Referring also to FIGS. 17 and 18, another embodiment of use of the assembly 142 of FIG. 15 is shown for a filtered connection. In this embodiment, the assembly 142 is used with a filter assembly 150. The filter assembly 150 generally comprises a lead 152 and a filter circuit 154. The lead 152 could comprise a printed circuit board and a connector trace on the printed circuit board similar to that described in U.S. patent application Ser. No. 10/359,843 which is hereby incorporated by reference in its entirety. The filter circuit 154 preferably comprises a plurality of capacitors.

In a preferred embodiment the filter circuit 154 comprises two groups of capacitors 155. The first group of capacitors comprises two capacitors connected in series. The second group of capacitors comprises a single capacitor. The first group of capacitors is connected in parallel with the second group of capacitors. However, in alternate embodiments, the filter circuit 154 could comprise more or less capacitors and the capacitors could be arranged in any suitable type of circuit configuration.

Figure 19:
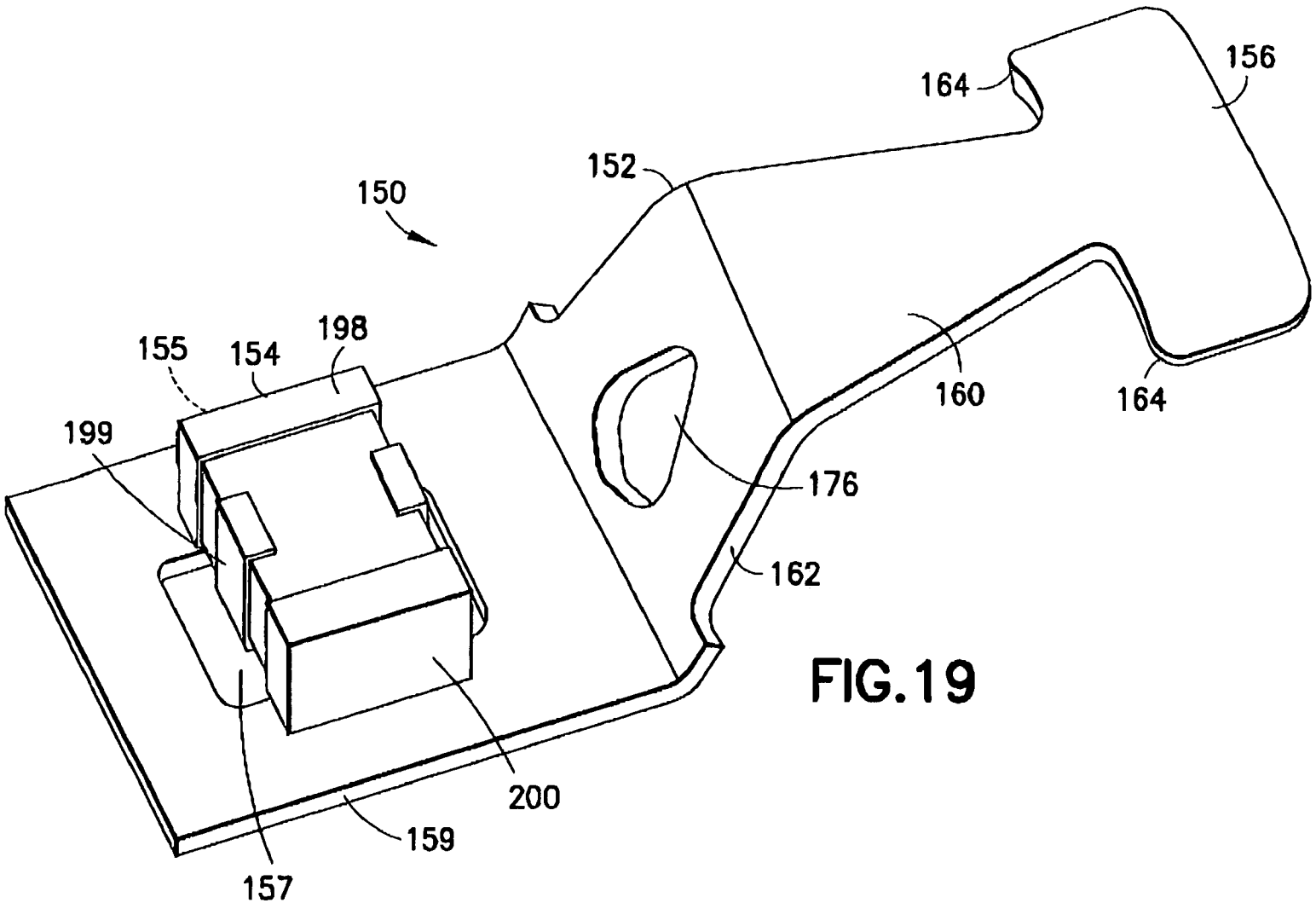
FIG. 19 is a perspective view of the filter assembly shown in FIG. 18.

Referring also to FIG. 19, a perspective view of the filter assembly 150 is shown. The filter circuit 154 is fixedly attached to the lead or lead frame 152. The connector lead 152 extends from the filter circuit 154 and is attached to the support and contact tab 134 of the terminal 110. More specifically, in the embodiment shown, the front 156 of the lead 152 contacts the lateral outer edge 158 of the tab 134. This connection at edge 158 comprises a removable wipe of the two surfaces against each other. Thus, the tab 134 can also function as an electrical contact section for connecting the terminal 110 to another member. The connection allows the terminal 110 to be replace and the filter assembly 150 used again. This contact wipe connection allows easier assembly of the connector without the need for soldering the filter assembly 150 to the terminal.

The two sections 160, 162 of the lead 152 function as resiliently deflectable contact spring beams. Hole 176 can be provided to increase flexibility without reducing twisting resistance. Front 156 forms a contact area for contacting the edge 158 of the tab 134. The front 156 has angled side sections 164 to help wedge the front 156 away front the tab 134 when the terminal 110 is being inserted into the connector housing. The filter circuit 154 is provided for EMI suppression and is preferably surface mounted (SMT) chip. Thus, the filter assembly consists of a combination electrical spring contact and a SMT chip holding lead frame for the purpose of forming the required electrical contact between an EMI suppression SMT chip and an automobile supplemental restraint system (SRS) firing circuit.

The filter circuit 154 is preferably provided as a chip which is surface mounted on a second contact area 159 of the lead frame 152 as a modular one-piece unit. The lead frame 152 has an aperture 157 therethrough which the chip 154 is mounted over. This provides an electrical air insulator without the need for adding additional electrical insulation. The filter circuit 154 has a plurality of capacitors as described above, and has its two end terminals 198, 200 surface mounted, such as soldered, to the lead frame 152; the ground terminal 199 being spaced from the lead frame by the hole 157 in the lead frame. The hole in the lead frame also provides access for easier mounting of the filter circuit. In an alternate embodiment, a hole in the lead frame might not be provided, such as if another type of electrical insulator is provided between the ground terminal of the filter circuit and the lead frame. In addition, any suitable means or system could be used to attach the filter circuit to the lead frame; it need not be surface mounted or merely surface soldered.

Figure 21:
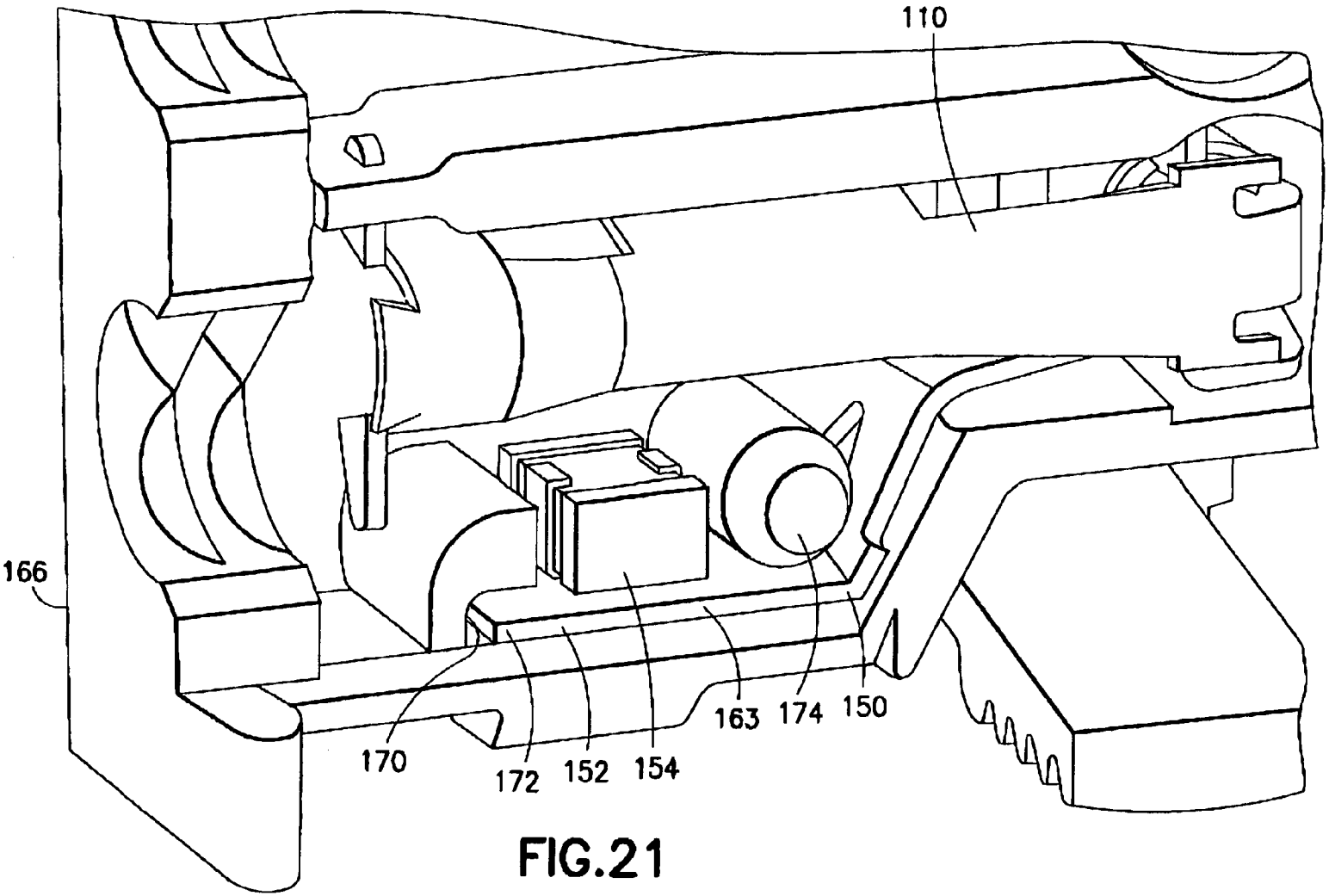
FIG. 21 is an enlarged partial perspective view of the housing and one of the filter assemblies shown in FIG. 20 with the assembly of FIG. 15 inserted into the housing.

Referring also to FIGS. 20 and 21, a housing 166 which is adapted to receive two of the filter assemblies 150 is shown. The force for the continued contact between the contact area of the front 156 of the lead 152 and the edge 158 of the tab 134 is provided by the housing 166 of the connector which constrains the lead 152 against the terminal 110 and the spring force of the lead 152. In an alternate embodiment, the lead 152 could be solder reflow connected to the terminal 110. The housing 166 has two conductor/wire receiving areas 168, 169. Each receiving area 168, 169 has a slot 170 for receiving a rear end 172 of the lead 152 and a post 174. The lead 152 is located in the receiving area with the post 174 located at the bend between the section 162 and the chip mounting section 163. The mounting section 163 and chip 154 are, thus, held relatively stationary in the housing. The sections 160, 162 of the lead, on the other hand, are able to deflect outward when the terminal 110 is inserted into the housing 166.

The filter circuit receiving area can be at any suitable location inside the housing of the connector. However, it has been found that locating the filter circuit receiving area at the area of the housing which receives the wire connection section of the terminal 110 provides the most efficient location for locating the filter circuit without significantly increasing the size of the connector. This also provides a good area on the contact 110 to connect the filter circuit, such as on at the lateral side of the wire. This embodiment illustrates that the assembly 142, and thus the contact 110, can be used in a filtered connector which has a filter circuit rather than a ferrite tube. The terminal 110 could be used in a connector which uses both a ferrite tube and a filter circuit. The terminal 110 could also be used in a connector which does not have a filter capability inside the housing of the connector, such as a system which uses coils outside the connector, as is commonly used in European air bag electrical connector systems.

In the past, filter circuits were provided in gas generators. However, when this type of gas generator was used, the filter circuit was discarded after use. With the present invention, by providing the filter circuit in the connector, rather than the in the gas generator or the gas generator's initiator, the filter circuit does not need to be discarded after the initiator is used. The connector and its filter circuit can be used with a new replacement gas generator and initiator. This can save costs because the gas generator and/or its initiator can be manufactured without it's own filter circuit, and capacitive filtering can still be provided; inside the connector rather than inside the gas generator initiator. The snap-lock assembly of the housing pieces 22, 24 can also allow the housing to be opened and the filter circuit 80 tested and/or repaired or replaced if desired.

Some airbag connectors, particularly in Europe, use a different filtering devices altogether (coils, for example) and incorporate them outside of the connector. In those applications, the tabs 134, 135 can be used to prevent the rotation of the terminal after it is assembled into housing. To perform this function the tabs could be locked into a corresponding grove of the plastic housing. This provides one more possible function of the "Tab" feature of the tab 134.

The unique features of the hooded terminal have multiple purposes. The tab on the terminal serves as 1) a stop for the ferrites in the housing, and 2) a "Positive stop" for the hood when it is pushed onto the terminal, and 3) the tab itself can be used as a "wiper" against the lead frame containing the small chip or any other electrical device (capacitor, resistor, coil) could be soldered to the tab. So although the tab 134 is designed to mate to (wipe) the lead frame, it is more general purpose in design.

A new feature (the tab 134) can be added to the existing terminals that can work with two different known filtering devices. It will allow replacement of a tube ferrite filter by a "lead frame" filter without having to modify the terminal. The feature also will protect the tub ferrite filter from cracking. The tabs on the terminal 110 can act as a stopper for both the hood and the ferrite filter. As noted above, the stopper can help protect the ferrite filter from cracking. The tab can also be incorporated into any existing electrical connector. The tab 134 can engage both a filter device (ferrite or lead frame) and a hood. Additionally, the use of a lead frame filter connected to a tab of a terminal in a connector housing is also new. The lead frame and housing are designed in such a way to prevent mechanical stresses from the contact deflection from being transferred into the SMT chip 154, thus, avoiding any problems these stresses might cause to the solder connection of the chip 154 to the lead frame 152.

Figure 22:
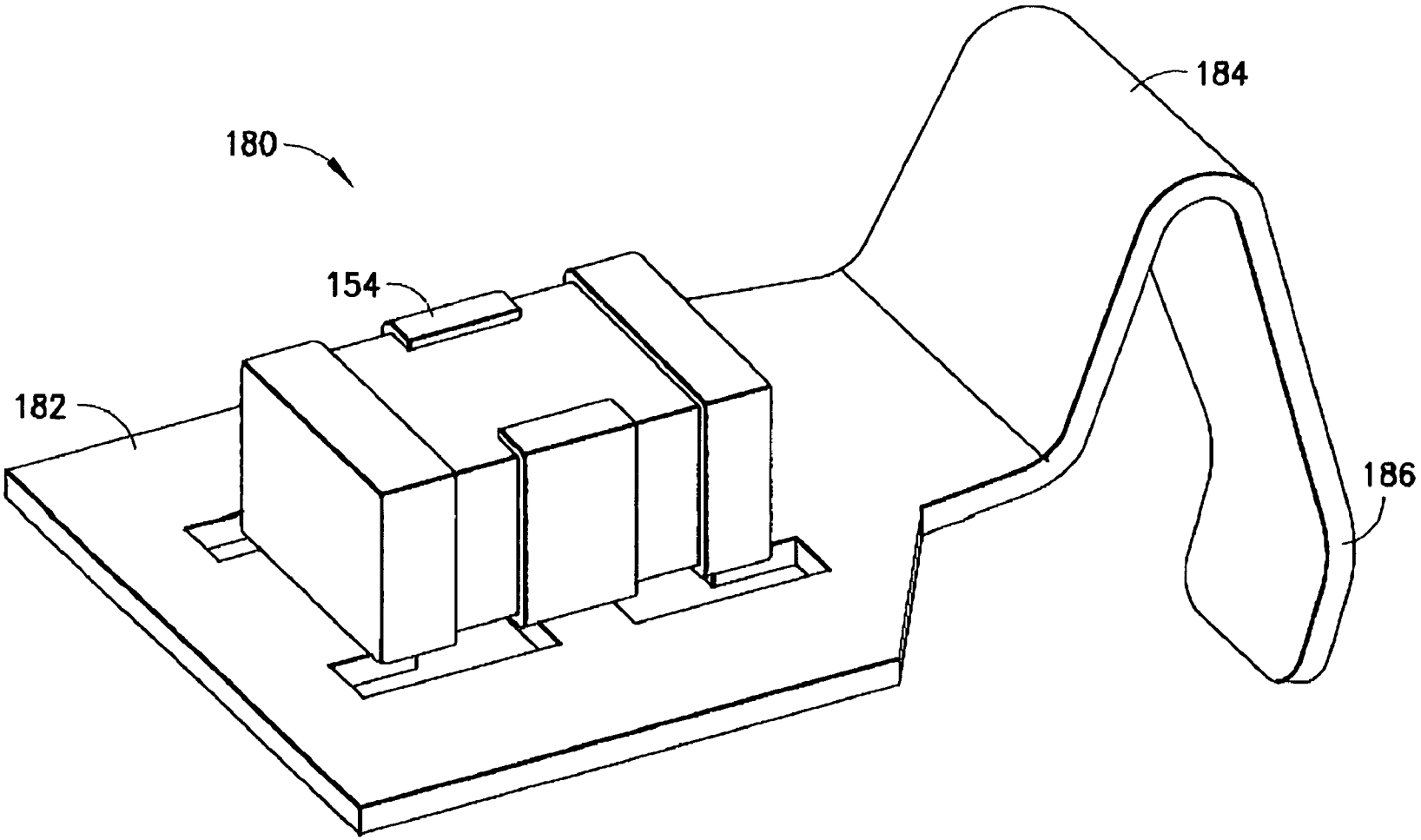
FIG. 22 is a perspective view of an alternate embodiment of the filter assembly shown in FIG. 19.

Referring now to FIG. 22, an alternate embodiment of the filter assembly is shown. The filter assembly 180 generally comprises the filter circuit 154 and a lead 182. The lead 182 is comprised of stamped and formed sheet metal. The lead 182 had a cantilevered arm 184 with a contact surface 186 for contacting the electrical contact or hood on the electrical contact. The arm 184 has a bent shape and is resiliently deflectable to enable a strong contact force against the contact or hood. This version could sit on the bottom of contact receiving cavity of the connector housing (instead of along the side) and contact the hood of the terminal.

Figure 23:
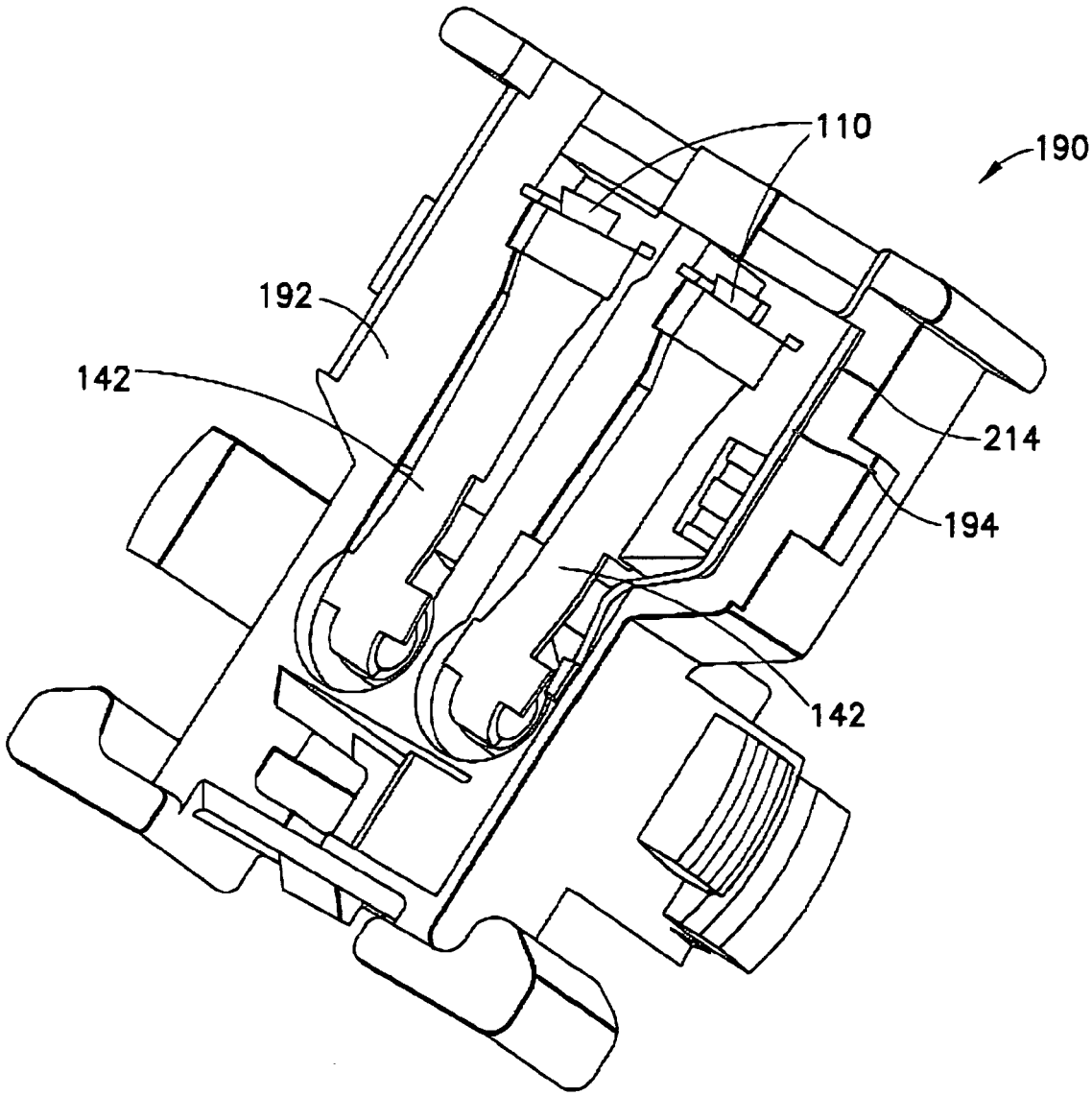
FIG. 23 is a perspective view of an air bag electrical connector, with a cover of the housing removed, showing an alternate embodiment.
Figure 24:
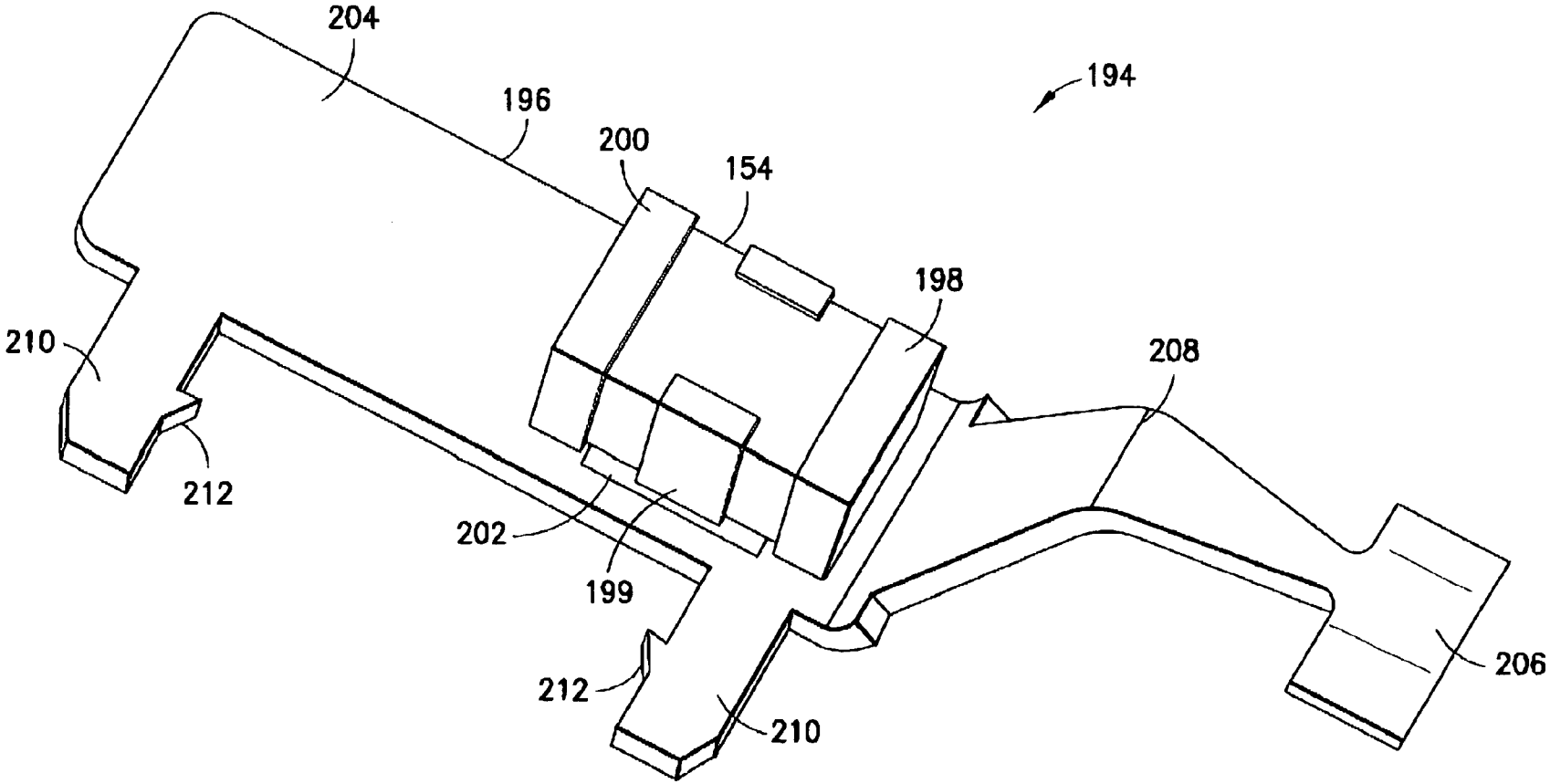
FIG. 24 is a perspective view of a filter assembly shown in FIG. 23.

FIG. 23 shows an air bag electrical connector with the cover of the housing removed. The connector 190 comprises a housing 192, two terminal assemblies 142 having electrical contacts or terminal 110, and a single filter assembly 194. Referring also to FIG. 24, the filter assembly 194 comprises a lead frame 196 and a filter circuit 154. The filter circuit 154 has a plurality of capacitors as described above, and has its two end terminals 198, 200 surface mounted, such as soldered, to the lead frame 196; the ground terminal 199 being spaced from the lead frame by a hole 202 in the lead frame.

The lead frame 196 is a one-piece metal member, such as cut and stamped sheet metal. The lead frame 196 comprises a mounting section 204, a terminal contact section 206 and a deflectable arm 208 therebetween. The mounting section 204 has the hole 202, and the filter circuit 154 is surface mounted over the hole 202, preferably such that the ground terminal 199 is spaced from the lead frame 196 (and thus electrically isolated from the lead frame 196). The mounting section 204 also comprises two mounting legs 210 having mounting barbs 212. As seen in FIG. 23, the housing 192 has a slot 214 which receives the filter assembly 194. The legs 210 and barbs 212 fixedly mount the mounting section 204 in the slot 214 with the housing 192. The terminal contact section 206 can contact the tab of one of the contacts 110, and the arm 208 is adapted to deflect to spring bias the terminal contact section 206 against the tab.

In this embodiment the terminal contact section 206 can be preloaded against a portion of the housing 192. The deflection of the terminal contact section 206 when the terminal assemblies 142 are inserted is very small, such as about 0.3 mm. This could raise concerns of proper contact if tolerances were too large. However, smaller size tolerances would increase the cost of manufacturing the connector. By preloading the terminal contact section against the housing, this can take away all concerns regarding tolerances without increasing the cost of the connector.

Figure 25:
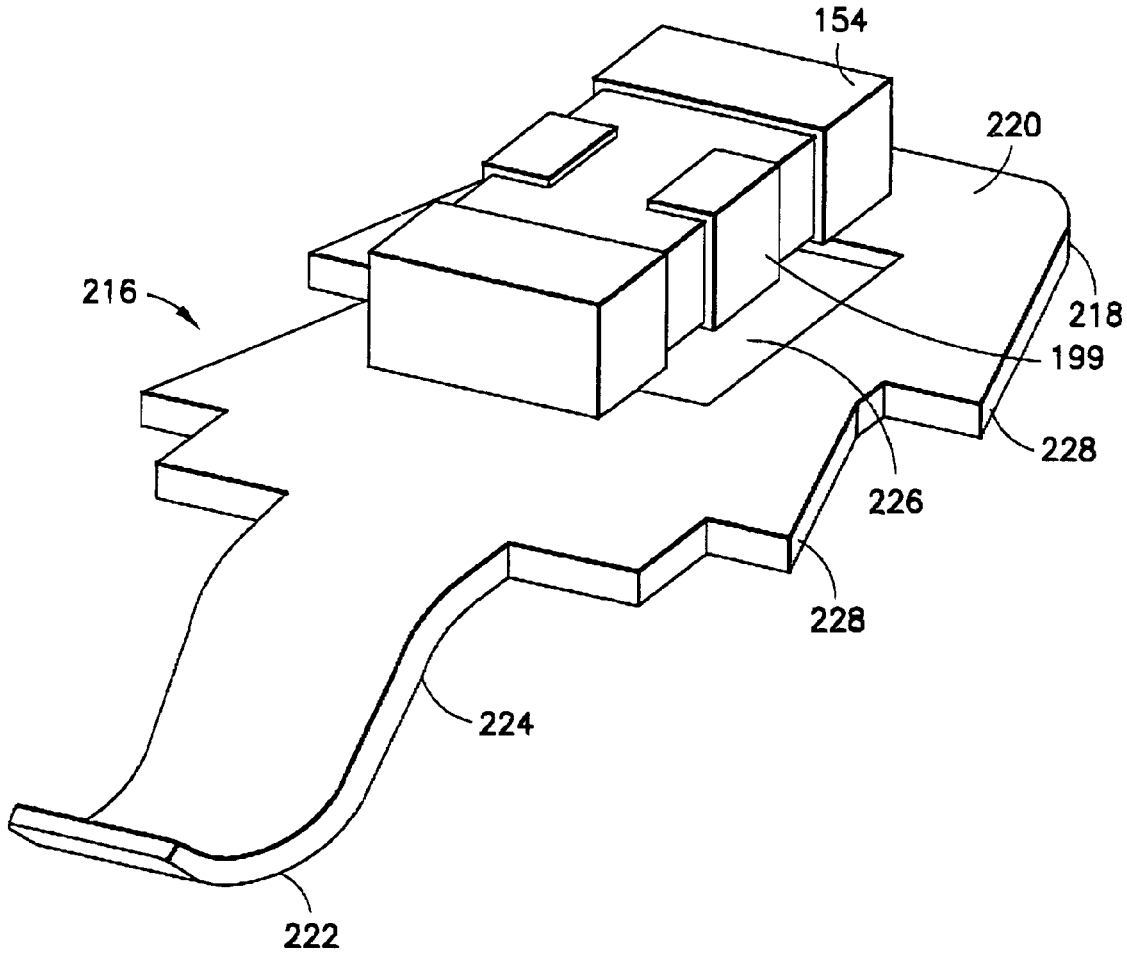
FIG. 25 is a perspective view of an alternate embodiment of the filter assembly shown in FIG. 24.

FIG. 25 shows an alternate embodiment of the filter assembly. In this embodiment, the filter assembly 216 comprises a lead frame 218 and a filter circuit 154. The lead frame 218 comprises a mounting section 220, a terminal contact section 222 and a deflectable arm 224 therebetween. The mounting section 220 has the hole 226, and the filter circuit 154 is surface mounted over the hole 226; preferably such that the ground terminal 199 is spaced from the lead frame 218 (and thus electrically isolated from the lead frame 218). The mounting section 220 also comprises two mounting barbs 228. The filter assembly 216 can be inserted into a housing (not shown) of an electrical connector and the mounting barbs can make a fixed connection of the lead frame to the housing. The terminal contact section can contact any suitable location on the electrical contact terminal.

Figure 26:
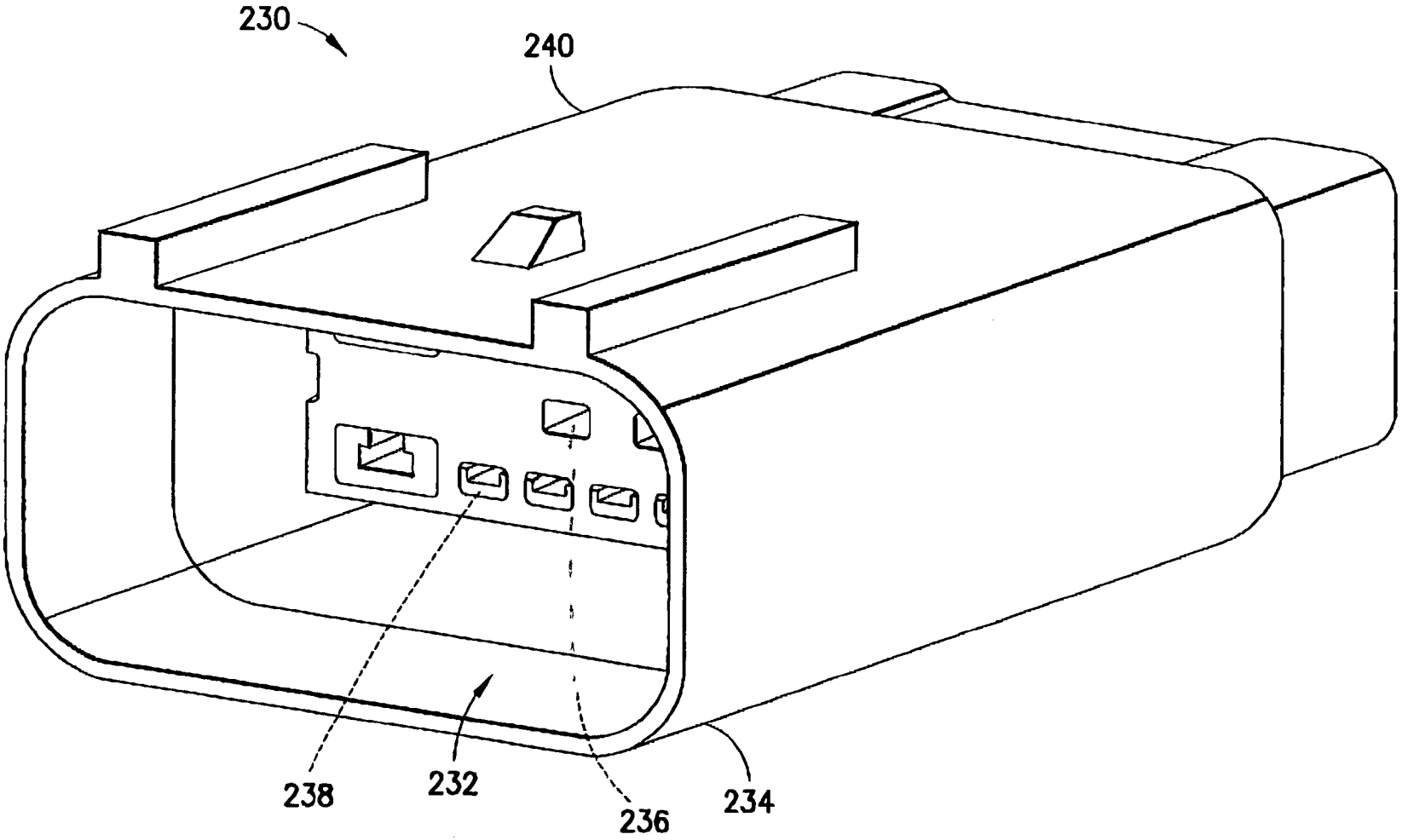
FIG. 26 is a perspective view of an electrical connector incorporating an alternate embodiment of the present invention.
Figure 27:
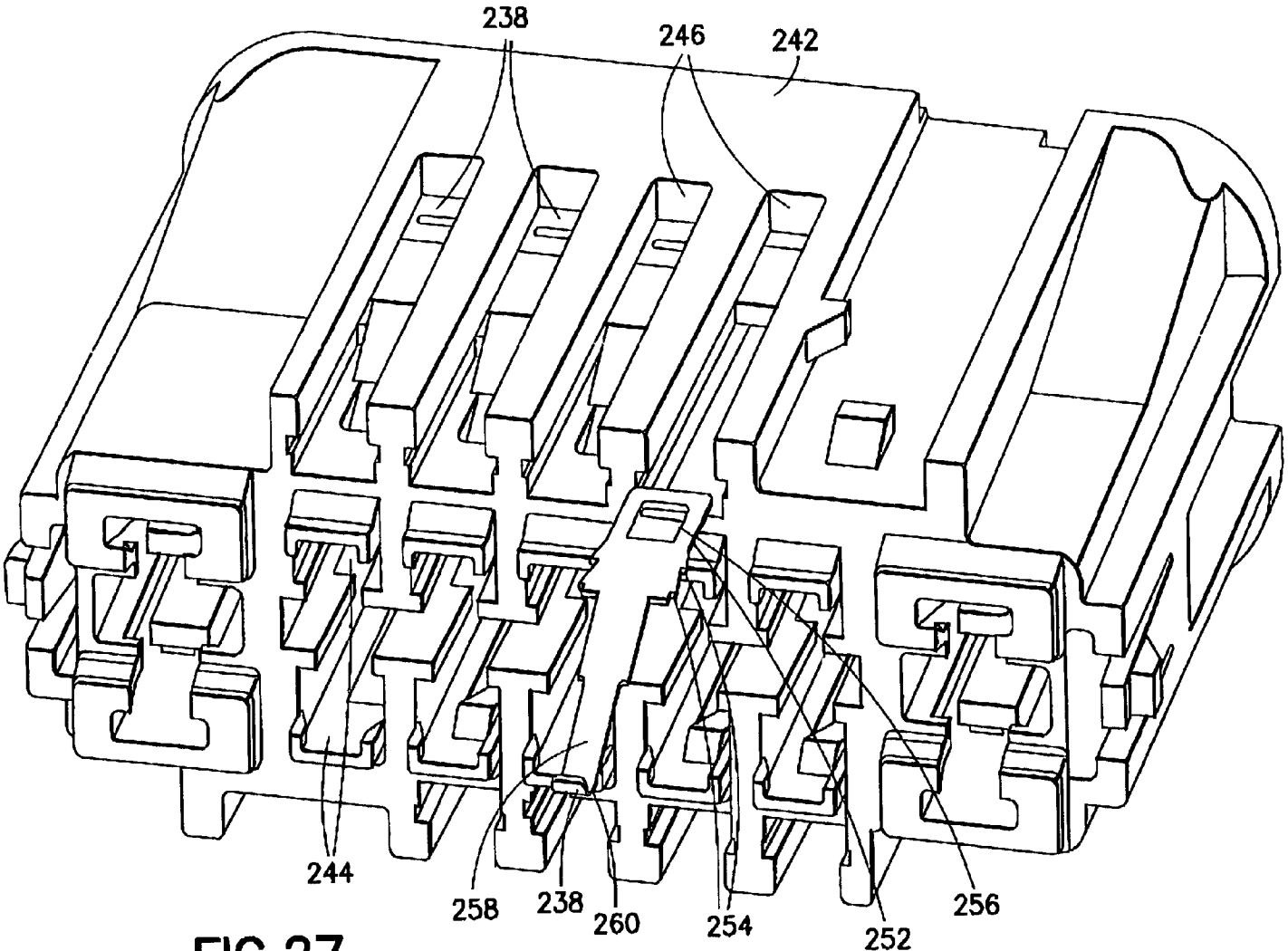
FIG. 27 is a partially exploded perspective view of components used to make the electrical connector shown in FIG. 26.
Figure 28:
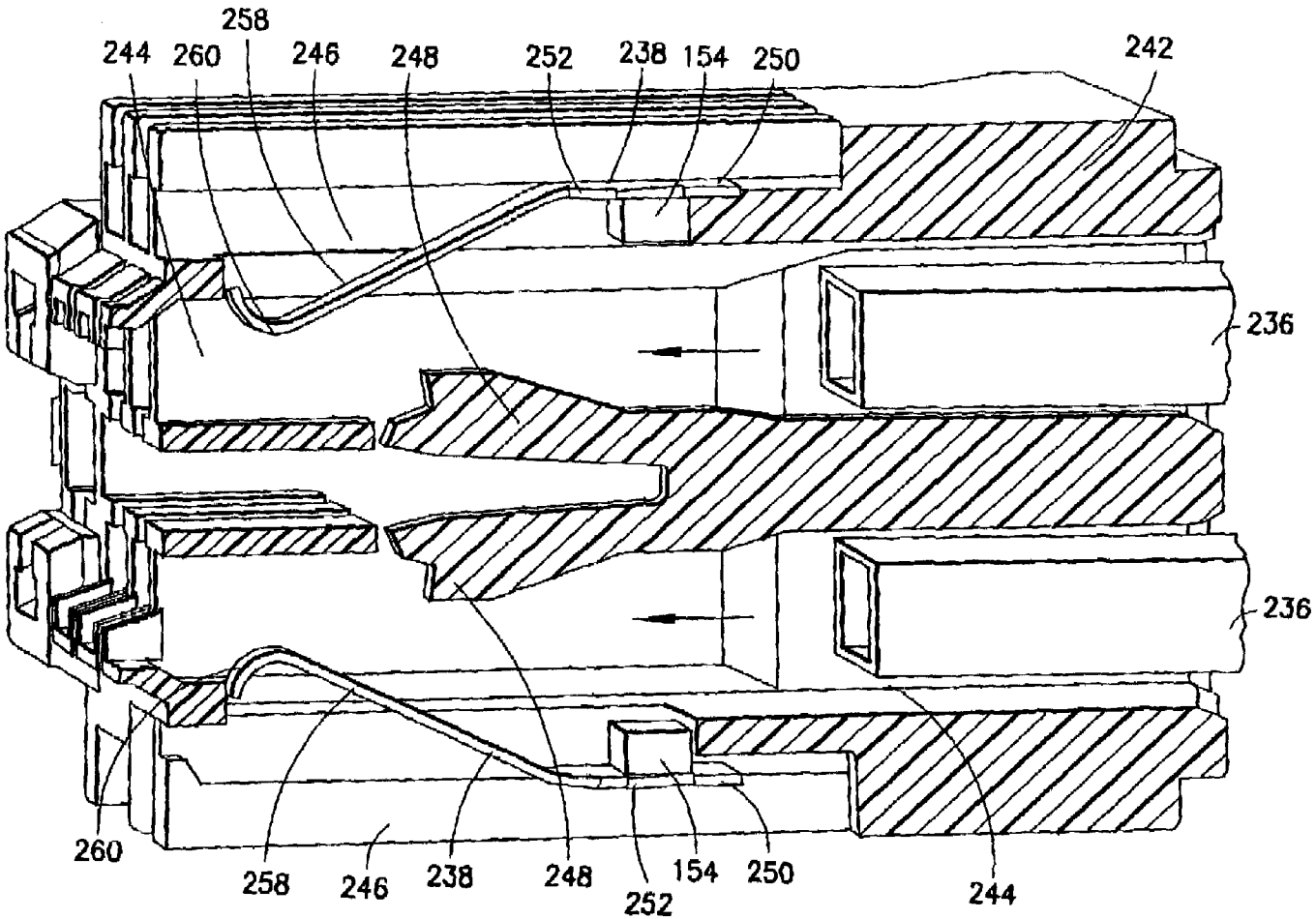
FIG. 28 is a cross sectional view of the housing component shown in FIG. 27 showing the location of the filter assemblies.

Referring now to FIGS. 26–28 an alternate embodiment of the present invention is shown. FIG. 26 shows an electrical connector 230 with an area 232 for receiving a mating electrical connector (not shown). The connector 230 comprises a housing 234, electrical contacts 236 (see FIG. 28), and filter assemblies 238 (see FIGS. 27 and 28). The housing 234 includes an outer housing 240 and an inner housing 242 shown in FIG. 27. As seen in FIGS. 27 and 28, the inner housing 242 comprises two rows of contact receiving areas 244, one located above the other, and two rows of filter assembly receiving areas 246. The filter assembly receiving areas 246 are located outward from and in registration with most, but not all, of the contact receiving areas 244. The contact receiving areas 244 and filter assembly receiving areas 246 are connected to each other such that the lead frames of the filter assemblies can project into the contact receiving areas 244 to contact the contacts 236. The inner housing 242 also comprises latches 248 for latching the contacts 236 inside the inner housing.

FIG. 27 shows the inner housing 242 during the assembly stage when the filter assemblies 238 are being inserted into the inner housing. The filter assemblies 238 each comprise a lead frame 250 and a capacitive filter circuit 154. The lead frame 250 has a mounting section 252 with mounting barbs 254 on opposite sides, and a hole 256. The filter circuit 154 is preferably surface mounted over the hole 256. The lead frame 250 has a deflectable cantilevered arm 258 with a contact area 260. The contact areas 260 extend into the contact receiving areas 244.

After the filter assemblies 238 are inserted into the inner housing 242, the contacts 236 are inserted into the inner housing as shown in FIG. 28. As the contacts 236 are inserted, they contact the contact areas 260 of the filter assemblies 238. The contacts 236 deflect the contact areas 260 outward and slide along the contact areas. When the contacts 236 are finally snap lock connected to the inner housing 242 by the latches 248, the contact areas 260 electrically connect the filter assemblies to the contacts. This type of construction allows the connection of the filter assemblies 238 to the contacts 236 to be done is separate attachment processes of the components to the housing. This construction also allows for movement between the filter assemblies and the contacts, such that the contacts 236 can move during mating connection with the electrical contacts of the mating electrical connector (not shown).

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector assembly comprising:

a housing which is sized and shaped to be plugged into an electrical connector socket of an initiator of a gas generator, the housing comprising at least one contact receiving hole;

electrical contact terminals on the housing, a first one of the terminals having a wire connection section and a female connection section, the first terminal being located in the at least one contact receiving hole, wherein the first terminal comprises an outwardly extending tab;

a hood surrounding the female connection section of the first terminal, wherein the hood comprises stamped and rolled sheet metal which has a general tube shape, wherein the tab of the first terminal extends outward beyond an outer side of the hood; and a filter member connected to the tab of the first terminal for providing electromagnetic induction suppression.

2. An electrical connector assembly as in claim 1 wherein the filter member comprises a ferrite tube located over the hood.

3. An electrical connector assembly as in claim 1 wherein the filter member comprises a filter circuit having capacitors assembled as a chip and connected to the first terminal by a spring contact lead frame.

4. An electrical connector assembly as in claim 3 wherein the capacitors comprise two groups of capacitors connected in parallel, and wherein a first one of the groups comprises two capacitors connected in series.

5. An electrical connector assembly as in claim 3 wherein the lead frame comprises a first contact area, a second contact area, and a spring beam section between the first and second contact areas, wherein the first contact area makes a wiping surface contact with the electrical contact.

6. An electrical connector assembly as in claim 4 wherein the chip is surface mounted on the second contact area and the second contact area comprises an aperture therethrough which the chip is mounted over.

7. An electrical connector assembly comprising:

a housing which is sized and shaped to be plugged into an electrical connector socket of an initiator of a gas generator, the housing comprising at least one contact receiving hole;

electrical contact terminals on the housing, a first one of the terminals having a wire connection section and a female connection section, the first terminal being located in the at least one contact receiving hole;

a hood surrounding the female connection section of the first terminal, wherein the hood comprises stamped and rolled sheet metal which has a general tube shape; and a filter member connected to the first terminal for providing electromagnetic induction suppression, wherein the filter member comprises a ferrite tube located over the hood, and wherein the first terminal comprises a cantilevered attachment section extending from a rear end of the female connection section, and wherein the ferrite tube is located against a top surface of a support tab of the cantilevered attachment section.

8. An electrical connector assembly comprising:

a housing which is sized and shaped to be plugged into an electrical connector socket of an initiator of a gas generator, the housing comprising at least one contact receiving hole;

electrical contact terminals on the housing, a first one of the terminals having a wire connection section and a female connection section, the first terminal being located in the at least one contact receiving hole;

a hood surrounding the female connection section of the first terminal, wherein the hood comprises stamped and rolled sheet metal which has a general tube shape; and a filter member connected to the first terminal for providing electromagnetic induction suppression, wherein the first terminal comprises a cantilevered attachment sections extending from a rear end of the female connection section, and wherein the hood comprises a rear end with a tab inwardly deformed onto a mounting tab of the cantilevered attachment sections behind a rear edge of the female connection section and in front of a support tab of the cantilevered attachment section.

9. An electrical connector assembly as in claim 8 wherein the support tabs extend outward past an outer side of the hood.

10. An electrical connector assembly comprising:

a housing which is sized and shaped to be plugged into an electrical connector socket of an initiator of a gas generator, the housing comprising at least one contact receiving hole;

electrical contact terminals on the housing, a first one of the terminals having a wire connection section and a female connection section, the first terminal being located in the at least one contact receiving hole; and a filter member connected to the first terminal for providing electromagnetic induction suppression, wherein the first terminal comprises a laterally extending tab, and wherein the filter member is electrically connected to the tab, wherein the first terminal comprises a cantilevered attachment section extending from a rear end of the female connection section, and wherein the cantilevered attachment section comprises the laterally extending tab.

11. An electrical connector assembly as in claim 10 wherein the filter member comprises a filter circuit having capacitors assembled as a chip and connected to the first terminal by a spring contact lead frame.

12. An electrical connector assembly as in claim 11 wherein the capacitors comprise two groups of capacitors connected in parallel, and wherein a first one of the groups comprises two capacitors connected in series.

13. An electrical connector assembly as in claim 11 wherein the lead frame comprises a first contact area, a second contact area, and a spring beam section between the first and second contact areas, wherein the first contact area makes a wiping surface contact with an outer tip of the laterally extending tab of the electrical contact.

14. An electrical connector assembly as in claim 13 wherein the chip is surface mounted on the second contact area and the second contact area comprises an aperture therethrough which the chip is mounted over.

15. An electrical connector assembly comprising:

a housing which is sized and shaped to be plugged into an electrical connector socket of an initiator of a gas generator, the housing comprising at least one contact receiving hole;

electrical contact terminals on the housing, a first one of the terminals having a wire connection section and a female connection section, the first terminal being located in the at least one contact receiving hole;

a filter member connected to the first terminal for providing electromagnetic induction suppression, wherein the first terminal comprises a laterally extending tab, and wherein the filter member is electrically connected to the tab;

a metal tube mounted over the female connection section and substantially stationarily attached to the female connection section; and a ferrite tube located over the hood, wherein the ferrite tube is located against a top surface of the laterally extending tab.

16. An electrical connector assembly comprising:

a housing which is sized and shaped to be plugged into an electrical connector socket of an initiator of a gas generator, the housing comprising at least one contact receiving hole;

electrical contact terminals on the housing, a first one of the terminals having a wire connection section and a female connection section, the first terminal being located in the at least one contact receiving hole;

a filter member connected to the first terminal for providing electromagnetic induction suppression, wherein the first terminal comprises a laterally extending tab, and wherein the filter member is electrically connected to the tab; and a metal tube mounted over the female connection section and substantially stationarily attached to the female connection section, wherein the first terminal comprises a cantilevered attachment section extending from a rear end of the female connection section, wherein the hood comprises a rear end with a tab inwardly deformed onto a mounting tab of the cantilevered attachment section behind a rear edge of the female connection section and in front of the laterally extending tab.

17. An electrical connector assembly as in claim 16 wherein the laterally extending tab extends outward past an outer side of the hood.

18. An electrical connector comprising:

a housing having a portion which is sized and shaped to be inserted into an electrical connector socket of an initiator of a gas generator; and an electrical contact in the housing, the electrical contact comprising a wire connection section, a female connection section, and an internal connecting section, wherein the internal connection section comprises a support and contact tab extending outward in a general cantilevered fashion proximate a base of the female connection section, wherein the support and contact tab forms a stop surface on which a hood can be positioned to position the hood relative to the female connection section, and wherein the support and control tab comprises an outer contact tip adapted to be contacted by a spring biased lead of a filter assembly.

19. An electrical connector as in claim 18 further comprising a metal hood mounted over the female connection section of the contact and having an end which is fixedly attached directly to the internal connection section.

20. An electrical connector as in claim 19 further comprising a ferrite tube mounted over the metal hood and having an end on the support and contact tab.

21. An electrical connector as in claim 18 further comprising a ferrite tube mounted over the female connection section and having an end on the support and contact tab.

22. An electrical connector as in claim 18 further comprising the filter assembly, wherein the filter assembly comprises a lead frame which forms the spring biased lead and a filter circuit comprising a chip having capacitors, wherein the lead frame comprises a contact area which is biased against the outer contact tip.

23. An electrical contact assembly comprising:

an electrical contact terminal comprising a wire connection section and a female connection section, wherein the female connection section comprises deflectable cantilevered arms, a rear tube section, and cantilevered attachment sections extending from a rear end of the rear tube section; and a metal hood on the female connection section, wherein the hood comprises a general tube shape with an inwardly rolled front end and a rear end with tabs inwardly deformed onto mounting tabs of the cantilevered attachment sections behind a rear edge of the rear tube section and in front of support tabs of the cantilevered attachment sections, wherein the support tabs extend outward past an outer side of the hood.

24. An air bag electrical connector comprising:

a housing which is sized and shaped to be plugged into an electrical connector socket of an initiator of a gas generator;

and an electrical contact assembly as in claim 23 in the housing.

* * * * *